US010539326B2

(12) United States Patent
Karkow et al.

(10) Patent No.: US 10,539,326 B2
(45) Date of Patent: Jan. 21, 2020

(54) DUPLEX BURNER WITH VELOCITY-COMPENSATED MESH AND THICKNESS

(71) Applicant: CLEARSIGN COMBUSTION CORPORATION, Seattle, WA (US)

(72) Inventors: Douglas W. Karkow, Des Moines, WA (US); Robert E. Breidenthal, Seattle, WA (US); Joseph Colannino, Bellevue, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 148 days.

(21) Appl. No.: 15/667,565

(22) Filed: Aug. 2, 2017

(65) Prior Publication Data

US 2018/0066846 A1 Mar. 8, 2018

Related U.S. Application Data

(60) Provisional application No. 62/384,696, filed on Sep. 7, 2016.

(51) Int. Cl.

| | |
|---|---|
| ***F23D 14/00*** | (2006.01) |
| ***F23Q 7/10*** | (2006.01) |
| ***F23D 14/02*** | (2006.01) |
| ***F23D 14/14*** | (2006.01) |
| ***F23Q 7/22*** | (2006.01) |

(52) U.S. Cl.

CPC ..... *F23Q 7/10* (2013.01); *F23D 14/02* (2013.01); *F23D 14/14* (2013.01); *F23Q 7/22* (2013.01)

(58) Field of Classification Search

CPC ... F23Q 7/10; F23Q 7/22; F23D 14/14; F23D 14/02

USPC ..... 429/423

See application file for complete search history.

(56) References Cited

U.S. PATENT DOCUMENTS

| | | | |
|---|---|---|---|
| 2,095,065 | A | 10/1937 | Hays |
| 2,828,813 | A | 4/1958 | Holden |
| 3,008,513 | A | 11/1961 | Holden |
| 3,155,142 | A | 11/1964 | Stack |
| 3,324,924 | A | 6/1967 | Hailstone et al. |
| 3,847,536 | A | 11/1974 | Lepage |
| 4,021,188 | A | 5/1977 | Yamagishi et al. |

(Continued)

FOREIGN PATENT DOCUMENTS

| | | |
|---|---|---|
| CN | 101046304 | 10/2007 |
| JP | 2006-275482 | 10/2006 |

(Continued)

OTHER PUBLICATIONS

Howell, J.R., et al.; "Combustion of Hydrocarbon Fuels Within Porous Inert Media," Dept. of Mechanical Engineering, The University of Texas at Austin. Prog. Energy Combust. Sci., 1996, vol. 22, p. 121-145.

(Continued)

*Primary Examiner* — Gary D Harris

(74) *Attorney, Agent, or Firm* — Christopher A. Wiklof; Nicholas S. Bromer; Launchpad IP, Inc.

(57) ABSTRACT

A combustion system includes a perforated reaction holder having perforations defined to compensate for a non-uniform velocity of fuel and/or oxidant received across an input face of the perforated reaction holder.

26 Claims, 17 Drawing Sheets

(56) References Cited

U.S. PATENT DOCUMENTS

| | | | | |
|---|---|---|---|---|
| 4,408,461 | A | 10/1983 | Bruhwiler et al. | |
| 4,483,673 | A | 11/1984 | Murai et al. | |
| 4,519,770 | A | 5/1985 | Kesselring et al. | |
| 4,643,667 | A | 2/1987 | Fleming | |
| 4,673,349 | A | 6/1987 | Abe et al. | |
| 4,752,213 | A | 6/1988 | Grochowski et al. | |
| 5,159,001 | A | 10/1992 | Motogami et al. | |
| 5,326,257 | A | 7/1994 | Taylor et al. | |
| 5,409,375 | A | 4/1995 | Butcher | |
| 5,439,372 | A | 8/1995 | Duret et al. | |
| 5,441,402 | A | 8/1995 | Reuther et al. | |
| 5,511,516 | A * | 4/1996 | Moore, Jr. | F23D 14/14 122/18.31 |
| 5,522,723 | A | 6/1996 | Durst et al. | |
| 5,641,282 | A | 6/1997 | Lee et al. | |
| 5,749,721 | A | 5/1998 | Klinge et al. | |
| 5,899,686 | A | 5/1999 | Carbone et al. | |
| 5,957,682 | A | 9/1999 | Kamal et al. | |
| 5,993,192 | A | 11/1999 | Schmidt et al. | |
| 6,129,545 | A | 10/2000 | Kahlke et al. | |
| 6,257,868 | B1 | 7/2001 | Durst et al. | |
| 6,997,701 | B2 | 2/2006 | Volkert et al. | |
| 7,241,137 | B2 | 7/2007 | Leinemann et al. | |
| 8,282,389 | B2 | 10/2012 | Dhulst et al. | |
| 9,377,190 | B2 | 6/2016 | Karkow et al. | |
| 9,388,981 | B2 | 7/2016 | Karkow et al. | |
| 9,447,965 | B2 | 9/2016 | Karkow et al. | |
| 9,562,682 | B2 | 2/2017 | Karkow et al. | |
| 2002/0155403 | A1 | 10/2002 | Griffin et al. | |
| 2003/0054313 | A1 | 3/2003 | Rattner et al. | |
| 2004/0058290 | A1 | 3/2004 | Mauzey et al. | |
| 2004/0152028 | A1 | 8/2004 | Singh et al. | |
| 2006/0008755 | A1 | 1/2006 | Leinemann et al. | |
| 2008/0124666 | A1 * | 5/2008 | Stocker | F23C 99/006 431/7 |
| 2008/0268387 | A1 | 10/2008 | Saito et al. | |
| 2009/0053664 | A1 | 2/2009 | Staller et al. | |
| 2010/0178219 | A1 | 7/2010 | Verykios et al. | |
| 2011/0076628 | A1 | 3/2011 | Miura et al. | |
| 2012/0164590 | A1 | 6/2012 | Mach | |
| 2012/0231398 | A1 | 9/2012 | Carpentier et al. | |
| 2015/0118629 | A1 | 4/2015 | Colannino et al. | |
| 2015/0276212 | A1 * | 10/2015 | Karkow | F23D 14/74 431/253 |
| 2015/0276217 | A1 | 10/2015 | Karkow et al. | |
| 2015/0316261 | A1 | 11/2015 | Karkow et al. | |
| 2015/0330625 | A1 | 11/2015 | Karkow et al. | |
| 2015/0362177 | A1 | 12/2015 | Krichtafovitch et al. | |
| 2015/0362178 | A1 | 12/2015 | Karkow et al. | |
| 2015/0369477 | A1 | 12/2015 | Karkow et al. | |
| 2016/0003471 | A1 | 1/2016 | Karkow et al. | |
| 2016/0018103 | A1 | 1/2016 | Karkow et al. | |
| 2016/0025333 | A1 | 1/2016 | Karkow et al. | |
| 2016/0025374 | A1 | 1/2016 | Karkow et al. | |
| 2016/0025380 | A1 | 1/2016 | Karkow et al. | |
| 2016/0046524 | A1 | 2/2016 | Colannino et al. | |
| 2016/0091200 | A1 | 3/2016 | Colannino et al. | |
| 2016/0230984 | A1 | 8/2016 | Colannino et al. | |
| 2016/0238240 | A1 | 8/2016 | Colannino et al. | |
| 2016/0238242 | A1 | 8/2016 | Karkow et al. | |
| 2016/0238277 | A1 | 8/2016 | Colannino et al. | |
| 2016/0238318 | A1 | 8/2016 | Colannino et al. | |
| 2016/0245509 | A1 | 8/2016 | Karkow et al. | |
| 2016/0276212 | A1 | 10/2016 | Rutkowski et al. | |
| 2016/0290639 | A1 | 10/2016 | Karkow et al. | |
| 2016/0298838 | A1 | 10/2016 | Karkow et al. | |
| 2016/0298840 | A1 | 10/2016 | Karkow et al. | |
| 2016/0305660 | A1 | 10/2016 | Colannino et al. | |
| 2016/0348899 | A1 | 12/2016 | Karkow et al. | |
| 2016/0348900 | A1 | 12/2016 | Colannino et al. | |
| 2016/0348901 | A1 | 12/2016 | Karkow et al. | |
| 2017/0010019 | A1 | 1/2017 | Karkow et al. | |
| 2017/0038063 | A1 | 2/2017 | Colannino et al. | |
| 2017/0038064 | A1 | 2/2017 | Colannino et al. | |
| 2017/0051913 | A1 | 2/2017 | Colannino et al. | |
| 2017/0146232 | A1 | 5/2017 | Karkow et al. | |
| 2017/0184303 | A1 | 6/2017 | Colannino et al. | |
| 2017/0191655 | A1 | 7/2017 | Colannino et al. | |
| 2017/0268772 | A1 | 9/2017 | Lang, Sr. et al. | |

FOREIGN PATENT DOCUMENTS

| | | |
|---|---|---|
| WO | WO 1995/000803 | 1/1995 |
| WO | WO 2015/123149 | 8/2015 |
| WO | WO 2015/123683 | 8/2015 |
| WO | WO 2016/105489 | 6/2016 |
| WO | WO 2016/133934 | 8/2016 |
| WO | WO 2016/133936 | 8/2016 |
| WO | WO 2016/134061 | 8/2016 |
| WO | WO 2016/134068 | 8/2016 |
| WO | WO 2016/141362 | 9/2016 |
| WO | WO 2017/048638 | 3/2017 |
| WO | WO 2017/1240008 | 7/2017 |

OTHER PUBLICATIONS

Arnold Schwarzenegger, "A Low NOx Porous Ceramics Burner Performance Study," California Energy Commission Public Interest Energy Research Program, Dec. 2007, San Diego State University Foundation, p. 5.

* cited by examiner

DUPLEX BURNER WITH VELOCITY-COMPENSATED MESH AND THICKNESS

CROSS REFERENCE TO RELATED APPLICATIONS

The present application claims priority benefit from U.S. Provisional Patent Application No. 62/384,696, entitled "DUPLEX BURNER WITH VELOCITY-COMPENSATED MESH AND THICKNESS," filed Sep. 7, 2016; which, to the extent not inconsistent with the disclosure herein, is incorporated by reference.

SUMMARY

Perforated reaction holders, also referred to as perforated flame holders, are disclosed in PCT Patent Application No. PCT/US2014/016632, entitled "FUEL COMBUSTION SYSTEM WITH A PERFORATED REACTION HOLDER," filed Feb. 14, 2014; PCT Patent Application No. PCT/US2014/016626, entitled "SELECTABLE DILUTION LOW NOX BURNER," filed Feb. 14, 2014; PCT Patent Application No. PCT/US2014/016628 entitled "PERFORATED FLAME HOLDER AND BURNER INCLUDING A PERFORATED FLAME HOLDER," filed Feb. 14, 2014; and PCT Patent Application No. PCT/US2014/016622, entitled "STARTUP METHOD AND MECHANISM FOR A BURNER HAVING A PERFORATED FLAME HOLDER," filed Feb. 14, 2014; each of which, to the extent not inconsistent with the disclosure and claims herein, is incorporated by reference in its entirety.

As described variously herein, a combustion system can benefit from utilizing a perforated reaction holder, and more particularly a perforated reaction holder having perforations configured to compensate for non-uniform velocity of a fuel and oxidant mixture received across the perforated reaction holder. Such compensation increases combustion efficiency within the perforated reaction holder.

According to an embodiment, a combustion system includes a combustion chamber, a fuel and oxidant source, and a perforated reaction holder. The fuel and oxidant source is oriented to emit fuel and oxidant into the combustion chamber. The perforated reaction holder is disposed in the combustion chamber and oriented to receive the fuel and oxidant at an input face. The perforated reaction holder defines a plurality of perforations of different sizes, where the perforations are selected arranged by size to accommodate a combustion reaction within each perforation when the fuel and oxidant are received at different velocities across a width of the perforated reaction holder.

According to an embodiment, a method of using a combustion system includes emitting fuel and oxidant from a fuel and oxidant source about a fuel and oxidant propagation axis such that an average velocity of the fuel and oxidant is higher at the fuel and oxidant propagation axis than at locations peripheral to the fuel and oxidant propagation axis. The fuel and oxidant are received at an input face of a perforated reaction holder supported in a combustion chamber, where the perforated reaction holder has a plurality of perforations disposed to extend between the input face and an output face of the perforated reaction holder. A combustion reaction is supported by the fuel and the oxidant at least partially within central perforations, of the plurality of perforations, that have a first dimension and in peripheral perforations, of the plurality of perforations, that have a second dimension different from the first dimension. The central perforations are disposed in a central region of the perforated reaction holder, which central region is aligned substantially coaxial to the fuel and oxidant propagation axis, and the peripheral perforations are disposed in a peripheral region axially peripheral to the central region. The first dimension and the second dimension of the respective central and peripheral perforations are selected to compensate for a difference in average velocity of the fuel and oxidant of the fuel and the oxidant received at the input face at the central perforations and the peripheral perforations.

DETAILED DESCRIPTION

Figure 1:
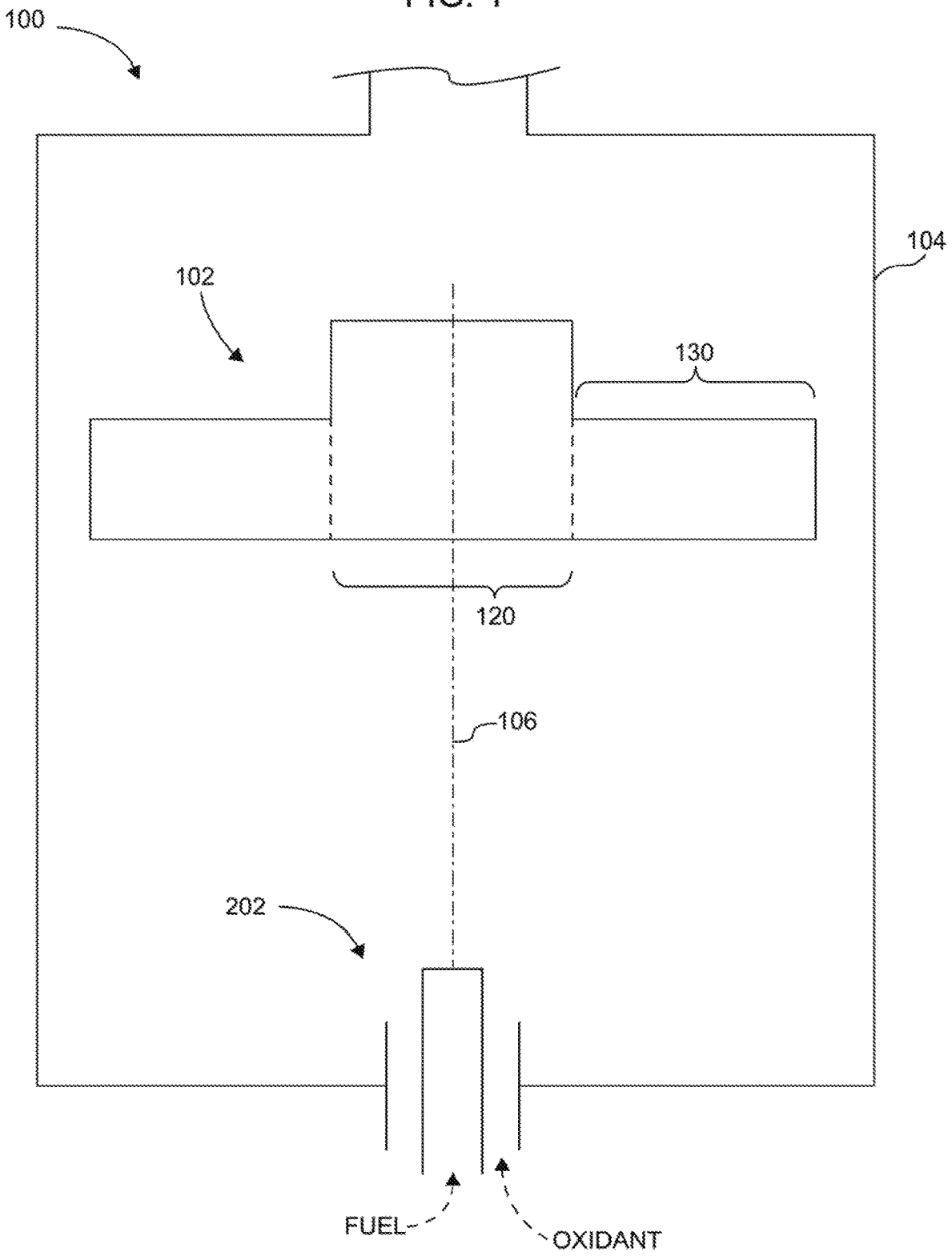
FIG. 1 is a simplified side view of a combustion system including a perforated reaction holder, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is a simplified view of a combustion system 100 including a perforated reaction holder 102 configured to be positioned in a combustion chamber 104, according to an embodiment. A fuel and oxidant source 202 provides fuel and oxidant along and about a fuel and oxidant propagation axis, often (but not always) straight ahead of the fuel orifice. Velocity of the fuel in a particular direction (e.g., a direction of emission) is, on average, highest along the fuel and oxidant propagation axis, and increasingly lower with distance from the fuel and oxidant propagation axis. Embodiments disclosed herein include features of the perforated reaction holder 102 configured to compensate for the non-uniform velocity of the fuel and oxidant received across an input face 212 (see FIG. 2) of the perforated reaction holder 102. In FIG. 1, such compensation features include a central region 120 of the perforated reaction holder 102 that is concentric to a central axis 106 of the perforated reaction holder 102 and that has perforations with a different dimension than perforations in a peripheral region 130 as described in greater detail below. For instance, the central region 120 may have a larger thickness dimension as illustrated in FIG. 1. The term "central" in central axis, although often geometrically germane, is used for convenience, and the central axis 106 may pass though a location other than a geometric center of the perforated reaction holder 102. The central axis 106 is to be central with respect to a fuel and oxidant impingement on the perforated reaction holder 102. That is, the central axis 106 is to be axially aligned with the fuel and oxidant propagation axis.

According to one interpretation, higher-velocity fuel and oxidant mixture needs more heat within a given distance to ignite and combust compared to a lower-velocity fuel and oxidant. Alternatively, a greater distance at a given temperature may be required to ignite and effectively combust the higher-velocity fuel and oxidant mixture compared to the lower-velocity fuel and oxidant mixture. Accordingly, to compensate for a non-uniform mass flow velocity of fuel and oxidant across the perforated reaction holder 102, the perforated reaction holder 102 may include at least two regions of perforations: (1) a first region about the central axis 106 and having perforations of a first dimension; and (2) a second region axially peripheral to the first region and intended to receive fuel and oxidant of lower average velocity and having perforations of a second dimension that is different than the first dimension. Naturally, intermediate regions may be included to more granularly address velocity differences.

According to an interpretation, at least two variations of perforation dimension may be applied, independently or together, to permit a more uniform heating and ignition of fuel and oxidant across a perforated reaction holder, by compensating for differences in velocity of fuel and oxidant received at different regions of the perforated reaction holder. In a first variation, the different regions of the perforated reaction holder 102 may include perforations having respectively different lateral dimensions. In a second variation, the different regions of the perforated reaction holder 102 may include perforations having respectively different lengths between input and output faces of the perforated reaction holder. A combination of these perforation dimension differences may be applied to amplify the effects in a smaller volume and/or to reach greater effect than can be achieved with a dimensional difference in only one direction.

For a given perforation length, perforations in the first region may have a smaller lateral dimension than perforations in the second region in order that thermal energy from the perforation walls may heat and ignite the higher-velocity fuel and oxidant comparatively more quickly. Ideally, the lateral dimensions of the perforations are such that thermal energy provided to the fuel and oxidant corresponds to the fuel and oxidant velocity while still permitting heat energy from the combustion reaction to be sufficiently absorbed by the perforated reaction holder 102 to self-sustain the combustion reaction. If the lateral dimension of a perforation is such that thermal energy provided from the perforation walls to fuel and oxidant is too high for a given fuel and oxidant velocity, combustion may happen too quickly and the combustion reaction may produce undesired combustion products. Moreover, premature or too-fast combustion may produce much more energy than the perforation walls can thermally absorb or process, potentially damaging the structure and/or wasting the energy. Fortunately, the temperature of the perforated reaction holder 102 can be controlled by changing the rate of fuel and oxidant delivery, and thus the rate of combustion.

According to an embodiment, the perforations may not be straight, and individual perforations may not have uniform cross-sectional dimensions as they extend between the input and output surfaces of the perforated reaction holder. For example, according, to an embodiment the perforated reaction holder may be a reticulated ceramic perforated reaction holder (FIG. 15A and FIG. 15B) having perforations defined as passages between reticulated fibers that make up the reticulated perforated reaction holder. The perforations may twist and branch as they extend between the input and output surfaces of the perforated reaction holder. Accordingly, the central perforations may be characterized by an average dimension that is different than an average dimension of the peripheral perforations. The average dimension can include one or more of an average length, an average width, an average cross-sectional area, or another type of dimension. Thus, although many of the figures show perforated reaction holders with perforations that are substantially straight in a vertical direction and that individually have a substantially uniform lateral dimension along their length, the principles illustrated in the figures extend to perforations that are not straight and that individually have lateral dimensions that differ along their length.

Figure 2:
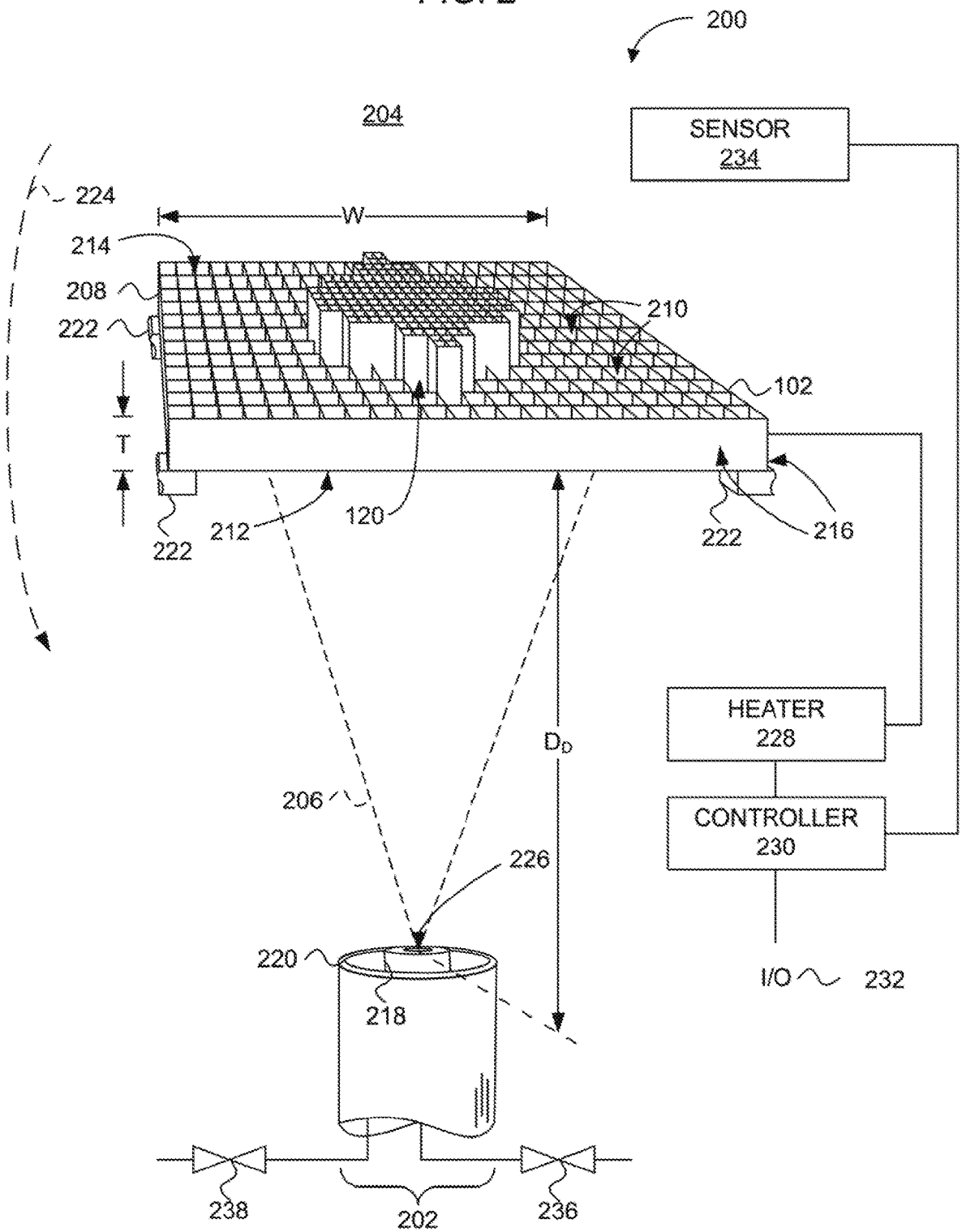
FIG. 2 is a simplified perspective view of a burner system including a perforated reaction holder, according to an embodiment.
Figure 3A:
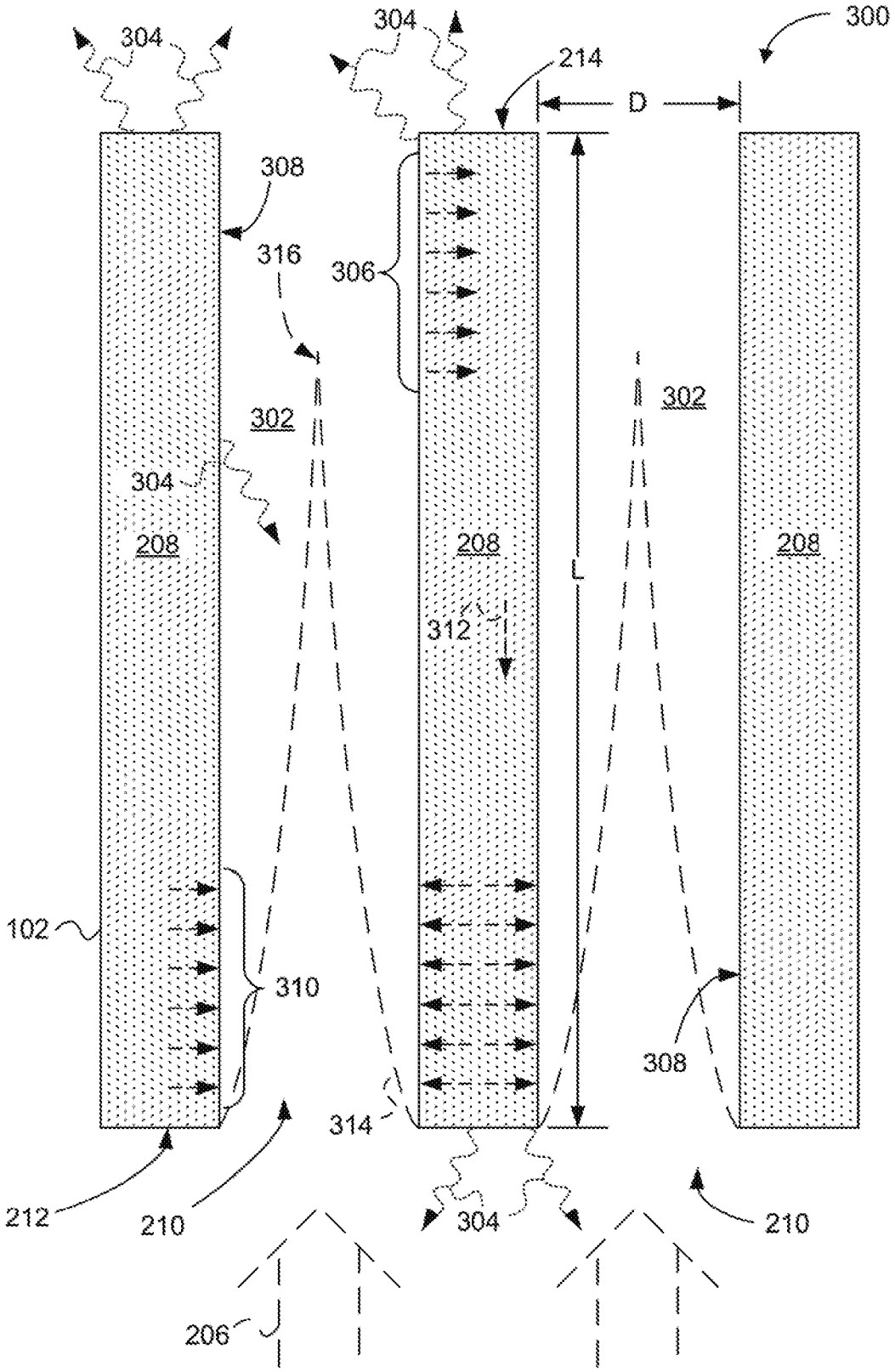
FIGS. 3A-B illustrate a side sectional diagram of a portion of the perforated reaction holder of FIGS. 1 and 2, according to an embodiment.
Figure 3B:
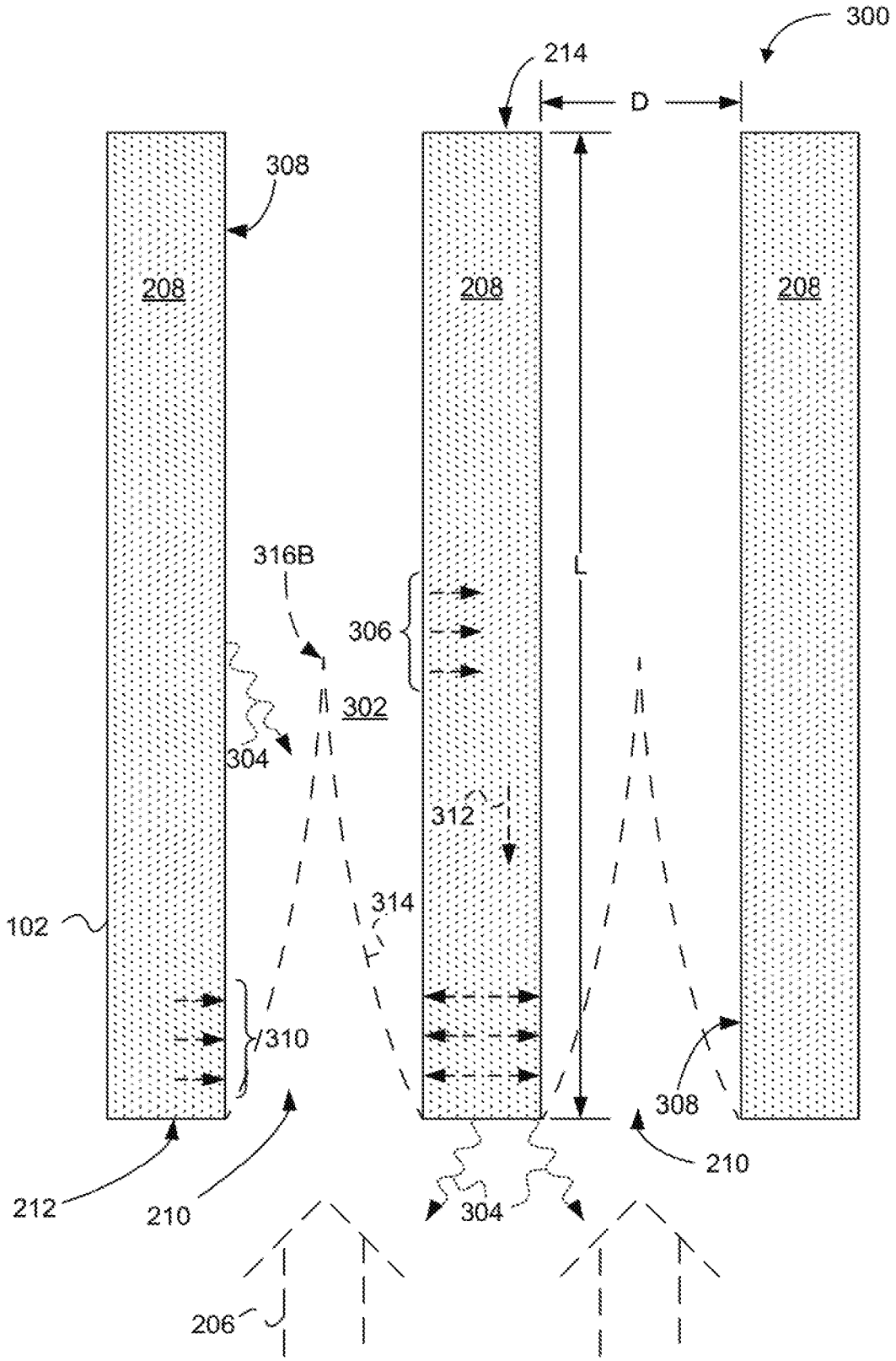
Figure 4:
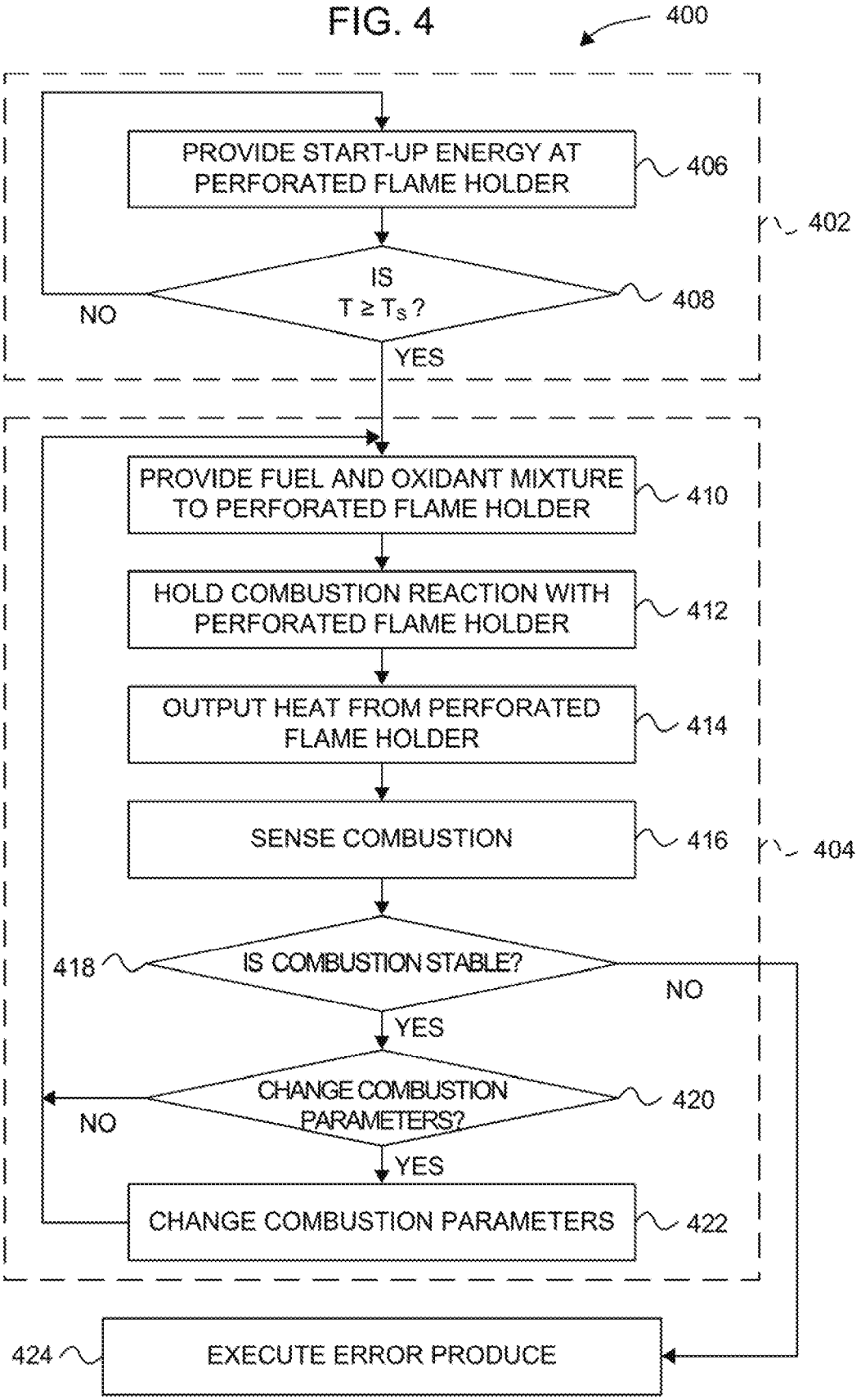
FIG. 4 is a flow chart showing a method for operating a burner system including the perforated reaction holder of FIGS. 1, 2 and 3, according to an embodiment.

Before discussing the details of specific embodiments, the following discussion related to FIGS. 2-4 provides a general discussion of perforated reaction holders devised by the inventors, along with their function and use. FIGS. 5A through 14 discuss embodiments that address the mass flow velocity differences noted above.

FIG. 2 is a simplified diagram of a combustion system 200 including a perforated reaction holder 102 configured to hold a combustion reaction, according to an embodiment. As used herein, the terms perforated reaction holder, perforated flame holder, porous flame holder, porous reaction holder, duplex, and duplex tile shall be considered synonymous unless further definition is provided.

Experiments performed by the inventors have shown that perforated reaction holders 102 described herein can support very clean combustion. Specifically, in experimental use of systems 200 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen (O2) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 202 disposed to output fuel and oxidant into a combustion volume 204 to form a fuel and oxidant mixture 206. As used herein, the terms "fuel and oxidant mixture" and "fuel stream" may be used interchangeably and considered synonymous depending on the context, unless further definition is provided. As used herein, the terms combustion volume, combustion chamber, furnace volume, and the like shall be considered synonymous unless further definition is provided. The perforated reaction holder 102 is disposed in the combustion volume 204 and positioned to receive the fuel and oxidant mixture 206 across an input face 212.

FIGS. 3A and 3B illustrate a side sectional diagram 300 of a portion of the perforated reaction holder 102 of FIGS. 1 and 2, according to an embodiment. Referring to FIGS. 2 and 3A, the perforated reaction holder 102 includes a perforated reaction holder body 208 defining a plurality of perforations 210 aligned to receive the fuel and oxidant mixture 206 from the fuel and oxidant source 202 (see FIGS. 1 and 2). The perforations 210 are configured to collectively hold a combustion reaction 302 supported by the fuel and oxidant mixture 206.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application the fuel can include fuel gas or byproducts from the process that include carbon monoxide (CO), hydrogen ($H_2$), and methane ($CH_4$). In another application the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated reaction holder body 208 may be bounded by the input face 212 disposed to receive the fuel and oxidant mixture 206, an output face 214 facing away from the fuel and oxidant source 202, and a peripheral surface 216 that defines a lateral extent of the perforated reaction holder 102. The plurality of perforations 210 which are defined by the perforated reaction holder body 208 extend from the input face 212 to the output face 214. The plurality of perforations 210 can receive the fuel and oxidant mixture 206 at the input face 212. The fuel and oxidant mixture 206 can then combust in or near the plurality of perforations 210 and combustion products can exit the plurality of perforations 210 at or near the output face 214.

According to an embodiment, the perforated reaction holder 102 is configured to hold a majority of the combustion reaction 302 within the perforations 210. For example, on a steady-state basis, more than half the molecules of fuel output into the combustion volume 204 by the fuel and oxidant source 202 may be converted to combustion products between the input face 212 and the output face 214 of the perforated reaction holder 102. According to an alternative interpretation, more than half of the heat or thermal energy output by the combustion reaction 302 may be produced between the input face 212 and the output face 214 of the perforated reaction holder 102. As used herein, the terms heat, heat energy, and thermal energy shall be considered synonymous unless further definition is provided. As used above, heat energy and thermal energy refer generally to energy, initially held in chemical form by reactants, that is released as heat during the combustion reaction 302. As used elsewhere herein, heat, heat energy and thermal energy correspond to a detectable temperature rise undergone by real bodies characterized by heat capacities. Under nominal operating conditions, the perforations 210 can be configured to collectively hold at least 80% of the combustion reaction 302 between the input face 212 and the output face 214 of the perforated reaction holder 102. In some experiments, the inventors produced a combustion reaction 302 that was apparently wholly contained in the perforations 210 between the input face 212 and the output face 214 of the perforated reaction holder 102. According to an alternative interpretation, the perforated reaction holder 102 can support combustion between the input face 212 and output face 214 when combustion is "time-averaged." For example, during transients, such as before the perforated reaction holder 102 is fully heated or if too high a (cooling) load is placed on the system, the combustion may travel somewhat downstream from the output face 214 of the perforated reaction holder 102. Alternatively, if the cooling load is relatively low and/or the furnace temperature reaches a high level, the combustion may travel somewhat upstream of the input face 212 of the perforated reaction holder 102.

While a "flame" is described in a manner intended for ease of description, it should be understood that in some instances, no visible flame is present. Combustion occurs primarily within the perforations 210, but the "glow" of combustion heat is dominated by a visible glow of the perforated reaction holder 102 itself. In other instances, the inventors have noted transient "flashback" or "huffing" wherein a visible flame momentarily ignites in a region lying between the input face 212 of the perforated reaction holder 102 and the fuel nozzle 218, within the dilution region $D_D$. Such transient flashback or huffing is generally short in duration such that, on a time-averaged basis, a majority of combustion occurs within the perforations 210 of the perforated reaction holder 102, between the input face 212 and the output face 214. In still other instances, the inventors have noted apparent combustion occurring downstream from the output face 214 of the perforated reaction holder 102, but still a majority of combustion occurred within the perforated reaction holder 102 as evidenced by continued visible glow from the perforated reaction holder 102 that was observed.

The perforated reaction holder 102 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as radiation, thermal radiation, radiant heat, heat radiation, etc. are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated reaction holder body 208.

Referring to the embodiment 300 in FIG. 3A, the perforated reaction holder 102 outputs another portion of the received heat 304 to the fuel and oxidant mixture 206 received at the input face 212 of the perforated reaction holder 102. The perforated reaction holder body 208 may receive heat from the combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was perceived as between ⅓ and ½ of the distance from the input face 212 to the output face 214 (i.e., somewhat nearer to the input face 212 than to the output face 214). The inventors contemplate that the heat receiving regions 306 may lie nearer to the output side 214 of the perforated reaction holder 102 under other conditions. Most probably, there is no clearly defined edge of the heat receiving regions 306 (or for that matter, the heat output regions 310, described below). However, for ease of understanding the heat receiving regions 306 and the heat output regions 310 will be described as particular regions 306, 310.

The perforated reaction holder body 208 can be characterized by a heat capacity. The perforated reaction holder body 208 may hold thermal energy from the combustion reaction 302 in an amount corresponding to the heat capacity multiplied by temperature rise, and transfer the thermal energy from the heat receiving regions 306 to heat output regions 310 of the perforation walls 308. Generally, the heat output regions 310 are nearer to the input face 212 than are the heat receiving regions 306. According to one interpretation, the perforated reaction holder body 208 can transfer heat from the heat receiving regions 306 to the heat output regions 310 via thermal radiation, depicted graphically as 304. According to another interpretation, the perforated reaction holder body 208 can transfer heat from the heat receiving regions 306 to the heat output regions 310 via heat conduction along heat conduction paths 312. The inventors contemplate that multiple heat transfer mechanisms including conduction, radiation, and possibly convection may be operative in transferring heat from the heat receiving regions 306 to the heat output regions 310. In this way, the perforated reaction holder 102 may act as a heat source to maintain the combustion reaction 302, even under conditions where a combustion reaction 302 would not be stable when supported from a conventional reaction holder.

The perforated reaction holder 102 may cause the combustion reaction 302 to begin within thermal boundary layers 314 formed adjacent to walls 308 of the perforations 210. Insofar as combustion is generally understood to include a large number of individual reactions, and since a large portion of combustion energy is released within the perforated reaction holder 102, it is apparent that at least a majority of the individual reactions occur within the perforated reaction holder 102.

As the comparatively cool fuel and oxidant mixture 206 approaches the input face 212, the flow is split into portions that respectively travel through individual perforations 210. The hot perforated reaction holder body 208 transfers heat to the fluid, notably within thermal boundary layers 314 that progressively thicken as more and more heat is transferred to the incoming fuel and oxidant mixture 206. After reaching a combustion temperature (e.g., the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and output face 214 that define the ends of the perforations 210. At some position along the length of a perforation 210, the combustion reaction 302 outputs more heat to the perforated reaction holder body 208 than it receives from the perforated reaction holder body 208. The heat is received at the heat receiving region 306, is held by the perforated reaction holder body 208, and is transported to the heat output region 310 nearer to the input face 212, where the heat is transferred into the cool reactants (and any included diluent) to bring the reactants to the ignition temperature.

In an embodiment, each of the perforations 210 is characterized by a length L defined as a reaction fluid propagation path length between the input face 212 and the output face 214 of the perforated reaction holder 102. As used herein, the term reaction fluid refers to matter that travels through a perforation 210. Near the input face 212, the reaction fluid includes the fuel and oxidant mixture 206 (optionally including nitrogen, flue gas, and/or other "non-reactive" species). Within the combustion reaction region, the reaction fluid may include plasma associated with the combustion reaction 302, molecules of reactants and their constituent parts, any non-reactive species, reaction intermediates (including transition states), and reaction products. Near the output face 214, the reaction fluid may include reaction products and byproducts, non-reactive gas, and excess oxidant.

The plurality of perforations 210 can be each characterized by a transverse dimension D between opposing perforation walls 308. The inventors have found that stable combustion can be maintained in the perforated reaction holder 102 at a particular fuel supply rate if the length L of each perforation 210 is at least four times the transverse dimension D of the perforation 210. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for thermal boundary layers 314 to form adjacent to the perforation walls 308 in a reaction fluid flowing through the perforations 210 to converge at merger points 316 within the perforations 210 between the input face 212 and the output face 214 of the perforated reaction holder 102. In experiments, the inventors have found L/D ratios between 12 and 48 to work well (i.e., produce low NOx, produce low CO, and maintain stable combustion).

The perforated reaction holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

However, it has been observed that a mass flow velocity of the fuel and air mixture 206 is non-uniform across the input face 212 of the perforated reaction holder 102. For example, the mass flow velocity may be, on average, highest near a nominal fuel or oxidant delivery axis (such as the fuel and oxidant propagation axis), and may decrease with distance away from the fuel/oxidant delivery axis. Thus a combustion reaction 302 in perforations 210 at a periphery of the perforated reaction holder 102 may produce less thermal energy and/or may output more un-combusted reactants than a combustion reaction at or near the fuel/oxidant delivery axis. A combustion reaction 302 might be supported only partially within the perforations 210 in an annular (or peripheral) region of the perforated reaction holder 102 characterized by a mass flow velocity below a higher mass flow velocity through a portion of the perforated reaction holder 102 that is axial to the annular region. Alternatively, during start-up, the combustion reaction may be supported only at least partially within perforations 210 in an elliptical region of the perforated reaction holder 102 characterized by a mass flow velocity below a higher mass flow velocity through a portion of the perforated reaction holder 102 circumferential to the elliptical region. It is acknowledged that, in contrast, if the fuel and oxidant are provided at a sufficient rate to realize efficient combustion in the annular/peripheral region, the combustion reaction 302 at perforations 210 axial to the peripheral region 130 may burn too hot, resulting in undesirable affects such as degradation of the combustion chamber 104, burner, etc., or damage to processed materials or heated fluids.

The embodiment 300 in FIG. 3B illustrates a combustion reaction 302 at a peripheral region of a perforated reaction holder 102 in which perforations 210 are not sized to compensate for a difference in mass flow velocity described above. The lower mass flow velocity at the peripheral region causes the thermal boundary layers 314 to merge at a point 3168 that is significantly closer to the input surface 212 as compared to the case with higher mass velocity illustrated in FIG. 3A. As a result, thermal energy received at heat receiving regions 306 of perforation walls 308 and radiated or convected to heat output regions 310 may be insufficient, or inconsistently sufficient, to maintain ignition of the incoming fuel and oxidant mixture 206. Conversely, heat received from the perforated reaction holder 102 may be insufficient to ignite or to fully consume the fuel and oxidant received at the lower mass velocity. That is, according to an interpretation, the lower mass flow velocity may alternatively cause incomplete combustion which may result in non-combusted fuel or intermediate combustion products coking the walls 308 of the perforations 210, potentially reducing or even closing the perforation 210.

Referring again to FIG. 2, the fuel and oxidant source 202 can further include a fuel nozzle 218, configured to output fuel, and an oxidant source 220 configured to output a fluid including the oxidant. For example, the fuel nozzle 218 can be configured to output pure fuel. The oxidant source 220 can be configured to output combustion air carrying oxygen, and/or optionally, recirculated flue gas.

The perforated reaction holder 102 can be held by a perforated reaction holder support structure 222 configured to hold the perforated reaction holder 102 at a dilution distance $D_D$ away from the fuel nozzle 218. In some embodiments, the perforated reaction holder 102 may be supported in the combustion chamber 104 by a plurality of rails, as described in parent international publication WO 2016/007564 incorporated by reference herein. The fuel nozzle 218 can be configured to emit a fuel jet selected to entrain the oxidant to form the fuel and oxidant mixture 206 as the fuel jet and oxidant travel along a path to the perforated reaction holder 102 through the dilution distance $D_D$ between the fuel nozzle 218 and the perforated reaction holder 102. Additionally or alternatively (particularly when a blower is used to deliver oxidant contained in combustion air), the oxidant or combustion air source 220 can be configured to entrain the fuel and the fuel and oxidant 206 travel through the dilution distance $D_D$. In some embodiments, a flue gas recirculation path 224 can be provided. Additionally or alternatively, the fuel nozzle 218 can be configured to emit a fuel jet selected to entrain the oxidant and to entrain flue gas as the fuel jet travels through the dilution distance $D_D$ between the fuel nozzle 218 and the input face 212 of the perforated reaction holder 102.

The fuel nozzle 218 can be configured to emit the fuel through one or more fuel orifices 226 having an inside diameter dimension that is referred to as "nozzle diameter." The perforated reaction holder support structure 222 can support the perforated reaction holder 102 to receive the fuel and oxidant mixture 206 at the distance $D_D$ away from the fuel nozzle 218 greater than 20 times the nozzle diameter. In another embodiment, the perforated reaction holder 102 is disposed to receive the fuel and oxidant mixture 206 at the distance $D_D$ away from the fuel nozzle 218 between 100 times and 1100 times the nozzle diameter. Preferably, the perforated reaction holder support structure 222 is configured to hold the perforated reaction holder 102 at a distance about 200 or more times of the nozzle diameter away from the fuel nozzle 218. When the fuel and oxidant mixture 206 travels about 200 times the nozzle diameter or more, the mixture is sufficiently homogenized to permit the combustion reaction 302 to produce minimal NOx.

The fuel and oxidant source 202 can alternatively include a premix fuel and oxidant source, according to an embodiment. A premix fuel and oxidant source can include a premix chamber (not shown), a fuel nozzle configured to output fuel into the premix chamber, and an oxidant (e.g., combustion air) channel configured to output the oxidant into the premix chamber. A flame arrestor (not shown) can be disposed between the premix fuel and oxidant source and the perforated reaction holder 102 and be configured to prevent flame flashback into the premix fuel and oxidant source.

The oxidant source 220, whether configured for entrainment in the combustion volume 204 or for premixing, can include a blower configured to force the oxidant through the fuel and oxidant source 202.

The support structure 222 can be configured to support the perforated reaction holder 102 from a floor or wall (not shown) of the combustion volume 204, for example. In another embodiment, the support structure 222 supports the perforated reaction holder 102 from the fuel and oxidant source 202. Alternatively, the support structure 222 can suspend the perforated reaction holder 102 from an overhead structure (such as a flue, in the case of an up-fired system).

The support structure 222 can support the perforated reaction holder 102 in various orientations and directions.

The perforated reaction holder 102 can include a single perforated reaction holder body 208. In another embodiment, the perforated reaction holder 102 can include a plurality of adjacent perforated reaction holder sections (e.g., tiles) that collectively provide a tiled perforated reaction holder 102.

The perforated reaction holder support structure 222 can be configured to support the plurality of perforated reaction holder sections. The perforated reaction holder support structure 222 can include a metal superalloy, a cementatious, and/or ceramic refractory material. In an embodiment, the plurality of adjacent perforated reaction holder sections can be joined with a fiber reinforced refractory cement.

The perforated reaction holder 102 can have a width dimension W between opposite sides of the peripheral surface 216 at least twice a thickness dimension T between the input face 212 and the output face 214. In another embodiment, the perforated reaction holder 102 can have a width dimension W between opposite sides of the peripheral surface 216 at least three times, at least six times, or at least nine times the thickness dimension T between the input face 212 and the output face 214 of the perforated reaction holder 102.

In an embodiment, the perforated reaction holder 102 can have a width dimension W less than a width of the combustion volume 204. This can allow the flue gas circulation path 224 from above to below the perforated reaction holder 102 to lie between the peripheral surface 216 of the perforated reaction holder 102 and the combustion volume wall (not shown in FIG. 2).

Referring again to both FIGS. 2 and 3A-B, the perforations 210 can be of various shapes. In an embodiment, the perforations 210 can include elongated squares, each having a transverse dimension D between opposing sides of the squares. In another embodiment, the perforations 210 can include elongated hexagons, each having a transverse dimension D between opposing sides of the hexagons. In yet another embodiment, the perforations 210 can include hollow cylinders, each having a transverse dimension D corresponding to a diameter of the cylinder. In another embodiment, the perforations 210 can include truncated cones or truncated pyramids (e.g., frustums), each having a transverse dimension D radially symmetric relative to a length axis that extends from the input face 212 to the output face 214. In some embodiments, the perforations 210 can each have a lateral dimension D equal to or greater than a quenching distance of the flame based on standard reference conditions. Alternatively, the perforations 210 may have lateral dimension D less then than a standard reference quenching distance.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example the plurality of perforations 210 can each have a lateral dimension D of about 0.2 to 0.4 inch.

The void fraction of a perforated reaction holder 102 is defined as the total volume of all perforations 210 in a section of the perforated reaction holder 102 divided by a total volume of the perforated reaction holder 102 including body 208 and perforations 210. The perforated reaction holder 102 should have a void fraction between 0.10 and 0.90. In an embodiment, the perforated reaction holder 102 can have a void fraction between 0.30 and 0.80. In another embodiment, the perforated reaction holder 102 can have a void fraction of about 0.70. Using a void fraction of about 0.70 was found to be especially effective for producing very low NOx.

The perforated reaction holder 102 can be formed from a fiber reinforced cast refractory material and/or a refractory material such as an aluminum silicate material. For example, the perforated reaction holder 102 can be formed to include mullite or cordierite. Additionally or alternatively, the perforated reaction holder body 208 can include a metal superalloy such as INCONEL or HASTELLOY. The perforated reaction holder body 208 can define a honeycomb. For example, the perforated reaction holder 102 can be formed from VERSAGRID ceramic honeycomb, available from Applied Ceramics, Inc. of Doraville, S.C. Honeycomb is an industrial term of art that need not strictly refer to a hexagonal cross section and most usually includes cells of square cross section. Honeycombs of other cross sectional areas are also known.

The perforations 210 can be parallel to one another and normal to the input and output faces 212, 214. In another embodiment, the perforations 210 can be parallel to one another and formed at an angle relative to the input and output faces 212, 214. In another embodiment, the perforations 210 can be non-parallel to one another. In another embodiment, the perforations 210 can be non-parallel to one another and non-intersecting. In another embodiment, the perforations 210 can be intersecting. The body 208 can be one piece or can be formed from a plurality of sections.

In another embodiment, the perforated reaction holder 102 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, which is not necessarily preferred, the perforated reaction holder 102 may be formed from a ceramic material that has been punched, bored or cast to create channels.

In another embodiment, the perforated reaction holder 102 can include a plurality of tubes or pipes bundled together. The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated reaction holder body 208 can alternatively include stacked or layered perforated sheets of material, each sheet having openings that connect with openings of subjacent and superjacent sheets. The perforated sheets can include perforated metal sheets, ceramic sheets and/or expanded sheets. In another embodiment, the perforated reaction holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic RASCHIG ring, ceramic Berl saddles, ceramic INTALOX saddles, and/or metal rings or other shapes (e.g. RASCHIG SUPER-RINGs) that may be held together by a metal cage.

The inventors contemplate various explanations for why burner systems including the perforated reaction holder 102 provide such clean combustion.

According to an embodiment, the perforated reaction holder 102 may act as a heat source to maintain a combustion reaction 302 even under conditions where a combustion reaction 302 would not be stable when supported by a conventional flame holder. This capability can be leveraged to support combustion using a leaner fuel-to-oxidant mixture than is typically feasible. Thus, according to an embodiment, at the point where the fuel stream 206 contacts the input face 212 of the perforated reaction holder 102, an average fuel-to-oxidant ratio of the fuel stream 206 is below a (conventional) lower combustion limit of the fuel component of the fuel stream 206. Lower combustion limit defines the lowest concentration of fuel at which a fuel and oxidant mixture 206 will burn when exposed to a momentary ignition source under normal atmospheric pressure and an ambient temperature of 25° C. (77° F.).

The perforated reaction holder 102 and systems including the perforated reaction holder 102 described herein were found to provide substantially complete combustion of CO (single digit ppm down to undetectable, depending on experimental conditions), while supporting low NOx. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced NOx formation. In one embodiment, "slightly lean" may refer to 3% $O_2$, i.e. an equivalence ratio of ~0.87. Use of even leaner mixtures is possible, but may result in elevated levels of $O_2$. Moreover, the inventors believe perforation walls 308 may act as a heat sink for the combustion fluid. This effect may alternatively or additionally reduce combustion temperatures and lower NOx.

According to another interpretation, production of NOx can be reduced if the combustion reaction 302 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated reaction holder 102 is very short compared to a conventional flame. The low NOx production associated with perforated reaction holder combustion may thus be related to the short duration of time required for the reactants (and entrained nitrogen) to pass through the perforated reaction holder 102.

FIG. 4 is a flow chart showing a method 400 for operating a burner system including the perforated reaction holder shown and described herein. To operate a burner system including a perforated reaction holder, the perforated reaction holder is first heated to a temperature sufficient to maintain combustion of the fuel and oxidant mixture.

According to a simplified description, the method 400 begins with step 402, wherein the perforated reaction holder is preheated to a start-up temperature, $T_S$. After the perforated reaction holder is raised to the start-up temperature, the method proceeds to step 404, wherein the fuel and oxidant are provided to the perforated reaction holder and combustion is held by the perforated reaction holder.

According to a more detailed description, step 402 begins with step 406, wherein start-up energy is provided at the perforated reaction holder. Simultaneously or following providing start-up energy, a decision step 408 determines whether the temperature T of the perforated reaction holder is at or above the start-up temperature, T. As long as the temperature of the perforated reaction holder is below its start-up temperature, the method loops between steps 406 and 408 within the preheat step 402. In step 408, if the temperature T of at least a predetermined portion of the perforated reaction holder is greater than or equal to the start-up temperature, the method 400 proceeds to overall step 404, wherein fuel and oxidant is supplied to and combustion is held by the perforated reaction holder.

Step 404 may be broken down into several discrete steps, at least some of which may occur simultaneously. Proceeding from step 408, a fuel and oxidant mixture is provided to the perforated reaction holder, as shown in step 410. The fuel and oxidant may be provided by a fuel and oxidant source that includes a separate fuel nozzle and oxidant (e.g., combustion air) source, for example. In this approach, the fuel and oxidant are output in one or more directions selected to cause the fuel and oxidant mixture to be received by the input face of the perforated reaction holder. The fuel may entrain the combustion air (or alternatively, the combustion air may dilute the fuel) to provide a fuel and oxidant mixture at the input face of the perforated reaction holder at a fuel dilution selected for a stable combustion reaction that can be held within the perforations of the perforated reaction holder.

Proceeding to step 412, the combustion reaction is held by the perforated reaction holder.

In step 414, heat may be output from the perforated reaction holder. The heat output from the perforated reaction holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the perforated reaction holder is very stable and no unusual sensing requirement is placed on the system. Combustion sensing may be performed using an infrared sensor, a video sensor, an ultraviolet sensor, a charged species sensor, thermocouple, thermopile, flame rod, and/or other combustion sensing apparatuses. In an additional or alternative variant of step 416, a pilot flame or other ignition source may be provided to cause ignition of the fuel and oxidant mixture in the event combustion is lost at the perforated reaction holder.

Proceeding to decision step 418, if combustion is sensed not to be stable, the method 400 may exit to step 424, wherein an error procedure is executed. For example, the error procedure may include turning off fuel flow, re-executing the preheating step 402, outputting an alarm signal, igniting a stand-by combustion system, or other steps. If, in step 418, combustion in the perforated reaction holder is determined to be stable, the method 400 proceeds to decision step 420, wherein it is determined if combustion parameters should be changed. If no combustion parameters are to be changed, the method loops (within step 404) back to step 410, and the combustion process continues. If a change in combustion parameters is indicated, the method 400 proceeds to step 422, wherein the combustion parameter change is executed. After changing the combustion parameter(s), the method loops (within step 404) back to step 410, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally or alternatively, if the combustion system is in a start-up mode, then fuel and oxidant flow may be gradually increased to the perforated reaction holder over one or more iterations of the loop within step 404.

Referring again to FIG. 2, the burner system 200 includes a heater 228 operatively coupled to the perforated reaction holder 102. As described in conjunction with FIGS. 3A-B and 4, the perforated reaction holder 102 operates by outputting heat to the incoming fuel and oxidant mixture 206. After combustion is established, this heat is provided by the combustion reaction 302; but before combustion is established, the heat is provided by the heater 228.

Various heating apparatuses have been used and are contemplated by the inventors. In some embodiments, the heater 228 can include a flame holder configured to support a flame disposed to heat the perforated reaction holder 102. The fuel and oxidant source 202 can include a fuel nozzle 218 configured to emit a fuel stream 206 and an oxidant source 220 configured to output oxidant (e.g., combustion air) adjacent to the fuel stream 206. The fuel nozzle 218 and oxidant source 220 can be configured to output the fuel stream 206 to be progressively diluted by the oxidant (e.g., combustion air). The perforated reaction holder 102 can be disposed to receive a diluted fuel and oxidant mixture 206 that supports a combustion reaction 302 that is stabilized by the perforated reaction holder 102 when the perforated reaction holder 102 is at an operating temperature. A start-up flame holder, in contrast, can be configured to support a start-up flame that is stable at a location corresponding to a relatively unmixed fuel and oxidant mixture without stabilization provided by the heated perforated reaction holder 102.

The burner system 200 can further include a controller 230 operatively coupled to the heater 228 and to a data interface 232. For example, the controller 230 can be configured to control a start-up reaction holder actuator configured to cause the start-up flame holder to hold the start-up flame when the perforated flame holder 102 needs to be pre-heated and to not hold the start-up flame when the perforated flame holder 102 is at an operating temperature (e.g., when $T \geq T_S$).

Various approaches for actuating a start-up flame are contemplated. In one embodiment, the start-up flame holder includes a mechanically-actuated bluff body configured to be actuated to intercept the fuel and oxidant mixture 206 to cause heat-recycling and/or stabilizing vortices and thereby hold a start-up flame; or to be actuated to not intercept the fuel and oxidant mixture 206 to cause the fuel and oxidant mixture 206 to proceed to the perforated flame holder 102. In another embodiment, a fuel control valve, blower, and/or damper may be used to select a fuel and oxidant mixture flow rate that is sufficiently low for a start-up flame to be jet-stabilized; and upon reaching a perforated flame holder 102 operating temperature, the flow rate may be increased to "blow out" the start-up flame. In another embodiment, the heater 228 may include an electrical power supply operatively coupled to the controller 230 and configured to apply an electrical charge or voltage to the fuel and oxidant mixture 206. An electrically conductive start-up flame holder may be selectively coupled to a voltage ground or other voltage selected to attract the electrical charge in the fuel and oxidant mixture 206. The attraction of the electrical charge was found by the inventors to cause a start-up flame to be held by the electrically conductive start-up flame holder.

In another embodiment, the heater 228 may include an electrical resistance heater configured to output heat to the perforated flame holder 102 and/or to the fuel and oxidant mixture 206. The electrical resistance heater 228 can be configured to heat up the perforated flame holder 102 to an operating temperature. The heater 228 can further include a power supply and a switch operable, under control of the controller 230, to selectively couple the power supply to the electrical resistance heater 228.

An electrical resistance heater 228 can be formed in various ways. For example, the electrical resistance heater 228 can be formed from KANTHAL® wire (available from Sandvik Materials Technology division of Sandvik AB of Hallstaham mar, Sweden) threaded through at least a portion of the perforations 210 defined by the perforated flame holder body 208. Alternatively, the heater 228 can include an inductive heater, a high-energy beam heater (e.g. microwave or laser), a frictional heater, electro-resistive ceramic coatings, or other types of heating technologies.

Other forms of start-up apparatuses are contemplated. For example, the heater 228 can include an electrical discharge igniter or hot surface igniter configured to output a pulsed ignition to the oxidant and fuel 206. Additionally or alternatively, a start-up apparatus can include a pilot flame apparatus disposed to ignite the fuel and oxidant mixture 206 that would otherwise enter the perforated flame holder 102. The electrical discharge igniter, hot surface igniter, and/or pilot flame apparatus can be operatively coupled to the controller 230, which can cause the electrical discharge igniter or pilot flame apparatus to maintain combustion of the fuel and oxidant mixture 206 in or upstream from the perforated flame holder 102 before the perforated flame holder 102 is heated sufficiently to maintain combustion.

The burner system 200 can further include a sensor 234 operatively coupled to the control circuit 230. The sensor 234 can include a heat sensor configured to detect infrared radiation or a temperature of the perforated flame holder 102. The control circuit 230 can be configured to control the heating apparatus 228 responsive to input from the sensor 234. Optionally, a fuel control valve 236 can be operatively coupled to the controller 230 and configured to control a flow of fuel to the fuel and oxidant source 202. Additionally or alternatively, an oxidant blower or damper 238 can be operatively coupled to the controller 230 and configured to control flow of the oxidant (or combustion air).

The sensor 234 can further include a combustion sensor operatively coupled to the control circuit 230, the combustion sensor being configured to detect a temperature, video image, and/or spectral characteristic of a combustion reaction 302 held by the perforated reaction holder 102. The fuel control valve 236 can be configured to control a flow of fuel from a fuel source to the fuel and oxidant source 202. The controller 230 can be configured to control the fuel control valve 236 responsive to input from the combustion sensor 234. The controller 230 can be configured to control the fuel control valve 236 and/or oxidant blower or damper 238 to control a preheat flame type of heater 228 to heat the perforated reaction holder 102 to an operating temperature. The controller 230 can similarly control the fuel control valve 236 and/or the oxidant blower or damper 238 to change the fuel and oxidant mixture 206 flow responsive to a heat demand change received as data via the data interface 232.

In the embodiment 300 of FIGS. 3A-3B, a tile of the perforated reaction holder body 208 is continuous. That is, the tile 208 may be formed from a single piece of material. The embodiment 300 of FIGS. 3A-3B also illustrates perforations 210 that are non-branching. That is, the perforated reaction holder body 208 defines perforations 210 that are separated from one another such that no flow crosses between perforations 210.

Optionally, the perforated reaction holder 102 can be formed from one or more pieces of material, and the perforations 210 can be branching or non-branching. Non-branching perforations 210 can be referred to as elongated apertures.

The perforated reaction holder body 208 defines a plurality of perforations 210 configured to convey the fuel and oxidant 206 and to hold the oxidation reaction supported by the fuel and oxidant 206. The perforated reaction holder body 208 is configured to receive heat from the combustion reaction 302, hold the heat, and output the heat to the fuel and oxidant 206 entering the perforations 210. The perforations 210 can maintain a substantially complete combustion reaction 302 of a leaner mixture of fuel and oxidant 206 than can be maintained outside of the perforations 210. An embodiment utilizing branching perforations 210 is discussed with respect to FIGS. 12A-12B below.

Figure 5A:
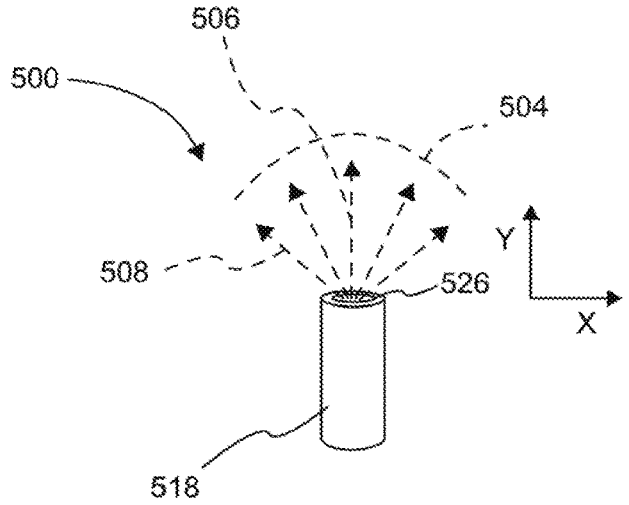
FIG. 5A is a simplified perspective view of a fuel source in operation, according to an embodiment.

FIG. 5A is a simplified perspective view 500 of a typical fuel nozzle 518 (such as the fuel nozzle 218 in FIG. 2) in operation. In cross-section, fuel emitted by the fuel nozzle 518 has a fuel velocity profile 504. Ignoring effects of gravity and other forces, the fuel velocity profile 504 illustrates that fuel emitted from the fuel nozzle 518 spreads from a relatively narrow orifice 526 (corresponding to the fuel orifice 226 in FIG. 2) to a typically much wider area. Fuel travels with substantially equal speed, but in different directions, from the orifice 526. In cross-section, fuel vectors range from those having almost exclusively Y-direction components at a center 506 of the fuel dispersion to those dividing the velocity more evenly between X and Y components at edges 508 of the fuel dispersion. As a result, when the fuel is emitted toward a downstream planar surface, such as the input surface of a perforated reaction holder 102, the fuel reaches the planar surface at different speeds in the Y-direction.

Figure 5B:
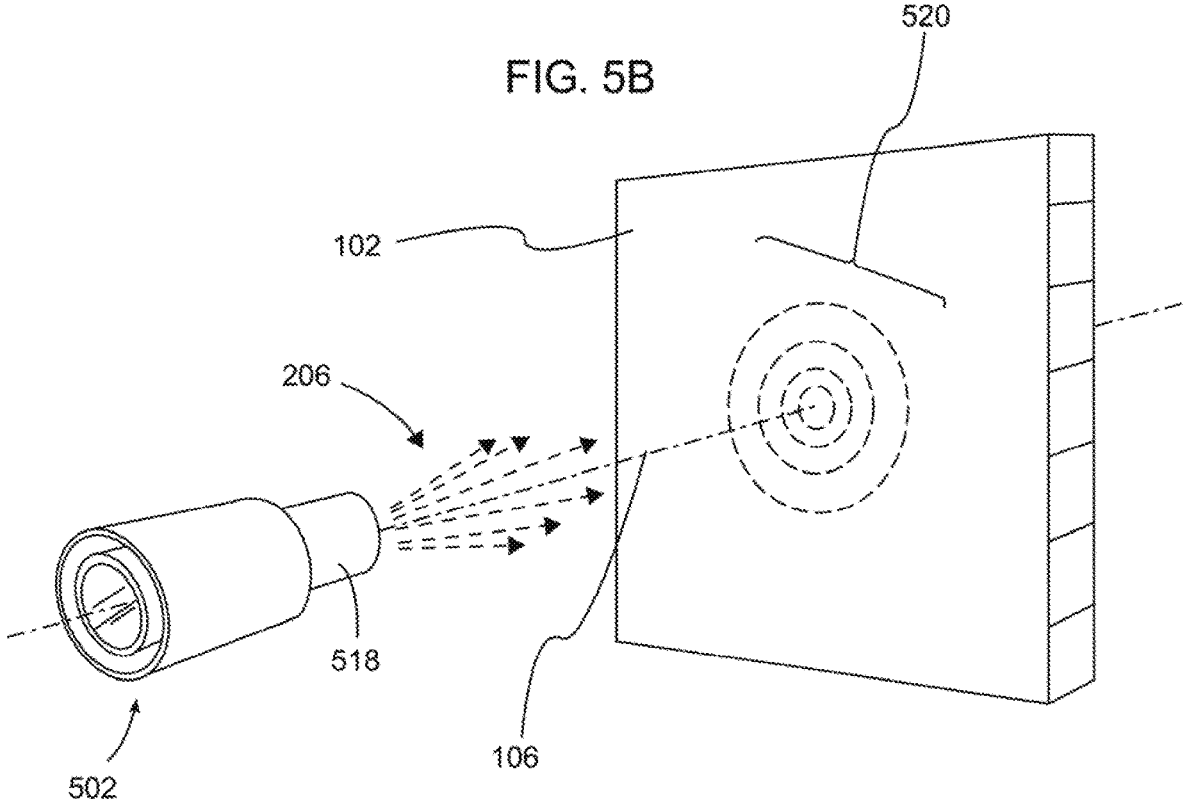
FIG. 5B is a simplified perspective view of a fuel and oxidant source and a perforated reaction holder, according to an embodiment.

FIG. 5B shows a simplified perspective view of a fuel and oxidant source 502 (corresponding to the fuel and oxidant source 202 in FIGS. 1 and 2), including the fuel nozzle 518, along with a perforated reaction holder 102. As described above, the fuel emitted from the fuel nozzle 518 entrains (and/or is entrained by) oxidant to provide a fuel and oxidant mixture 206. The fuel and oxidant mixture 206 reaches the perforated reaction holder 102 at different flow direction rates, as described above with respect to FIG. 5A, and the resulting fuel and oxidant mixture 206 thus has its highest average velocity along and proximate the fuel and oxidant propagation axis 106. A portion of the fuel and oxidant mixture 206 having the highest-average velocity thus reaches the perforated reaction holder 102 in a central region 520 (corresponding to the central region 120 in FIGS. 1 and 2) of the perforated reaction holder 102. The fuel and oxidant mixture 206 has an increasingly lower average forward velocity (i.e., in the direction of the perforated reaction holder 102) the farther away it is from the fuel and oxidant propagation axis 106.

The inventors have recognized a need to compensate for the non-uniform speed of the fuel and/or oxidant mixture 206 reaching the perforated reaction holder 102. The following disclosure details structures and methods for such compensation.

Figure 6A:
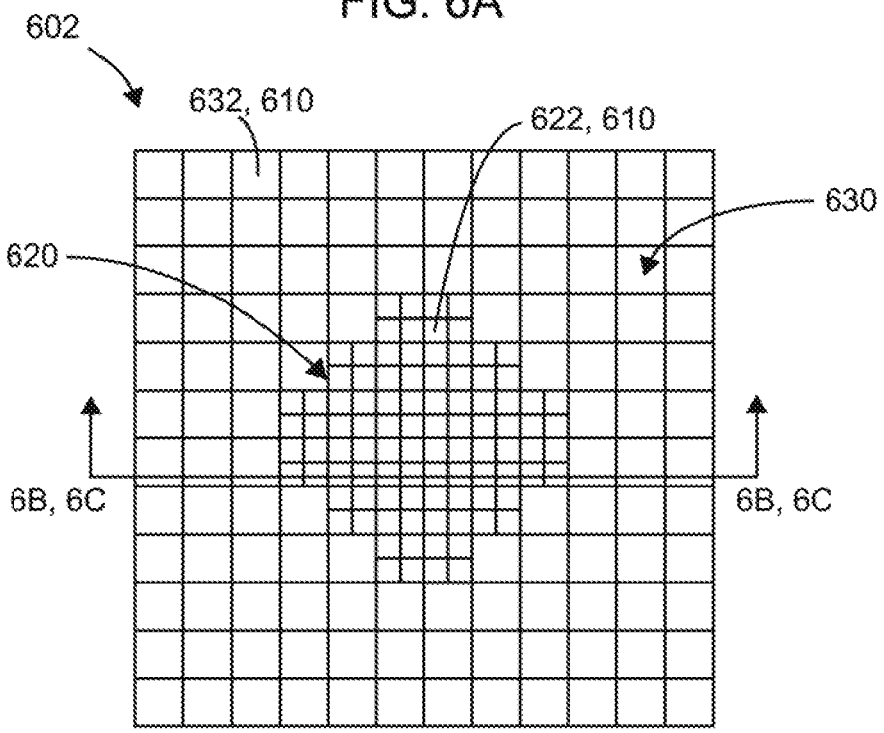
FIG. 6A is a top view of a perforated reaction holder having a variety of perforation sizes, according to an embodiment.

FIG. 6A is a top view of a perforated reaction holder 602 (corresponding to perforated reaction holder 102 in FIGS. 1 and 2) having perforations 610 with a plurality of dimensions. In the illustrated embodiment, a central region 620 and a peripheral region 630 have perforations 632 with respectively different dimensions. More specifically, the central region 620 may incorporate central perforations 622 having a first dimension while the peripheral region 630 incorporates peripheral perforations 632 having a second dimension different from the first dimension. As illustrated, the central region 620 may be disposed centrally to the perforated reaction holder 602, while the peripheral region 630 is disposed peripheral to the central region 620. The central region 620 is to be aligned about an axis of highest average velocity for receipt of fuel and oxidant (such as the fuel and oxidant propagation axis 106 described above). Alternative side cross-sections 602(*a*-*c*) of the perforated reaction holder 602 are shown in FIGS. 6B-6C.

Figure 6B:
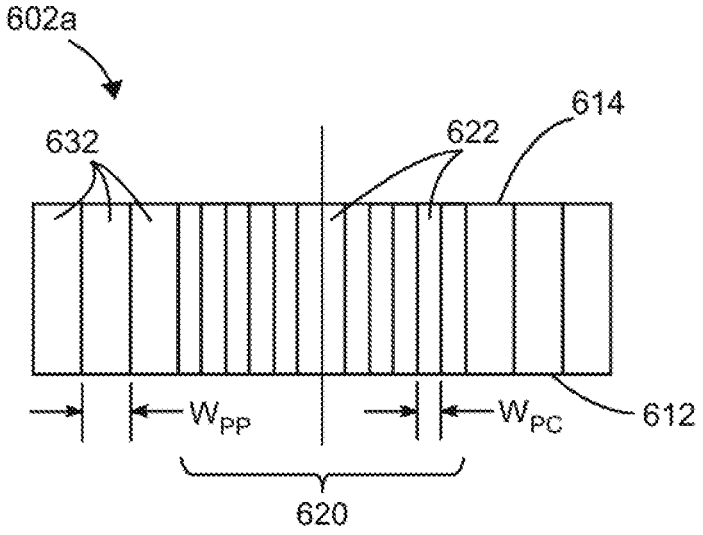
FIG. 6B is a side section view of the perforated reaction holder in FIG. 6A, according to an embodiment.

FIG. 6B is a side section view 602*a* of the perforated reaction holder 602 in FIG. 6A in which the central perforations 622 and the peripheral perforations 632 have respectively different lateral dimensions as the first dimension and second dimension while maintaining a substantially constant perforation length dimension between the input face 612 and output face 614. More specifically, the input face 612 and output face 614 are substantially planar and parallel to each other. The central perforations 622 have a first lateral dimension, $W_{PC}$, while peripheral perforations 632 have a second lateral dimension, $W_{PP}$. To address the mass flow velocity differences of fuel and oxidant 206 received at the input face 612, the first lateral dimension $W_{PC}$ of the central perforations 622 may be smaller than the second lateral dimension $W_{PP}$ of the peripheral perforations 632. The central perforations 622 and peripheral perforations 632 have respective length to lateral dimension ratios L/D that at least partially compensate for the difference in mass flow velocity of the fuel and oxidant mixture 206 received respectively at the central region 620 and peripheral region 630 as described above.

According to an embodiment, in the case of a reticulated ceramic perforated reaction holder 102 (FIG. 15A and FIG. 15B), the central perforations 622 may have a first average lateral dimension and the peripheral perforations 632 may have a second average lateral dimension. The first average lateral dimension is smaller than the second average lateral dimension.

Figure 6C:
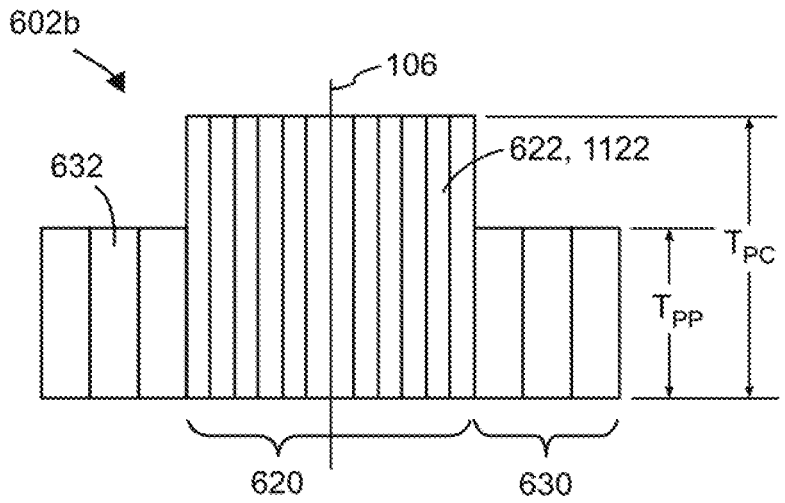
FIG. 6C is a side section view of the perforated reaction holder in FIG. 6A, according to another embodiment.

FIG. 6C is a side section view 602*b* of the perforated reaction holder 602 in FIG. 6A. In addition to the different lateral dimensions $W_{PC}$, $W_{PP}$ for the central and peripheral perforations 622, 632 as described for FIG. 6B, the central perforations 632 in FIG. 6C may have a different length dimension between the input face 612 and output face 614 than do the peripheral perforations 632. That is, the central perforations 622 have a length dimension $T_{PC}$ and the peripheral perforations 632 have a length dimension $T_{PP}$. The length dimension $T_{PC}$ of the central perforations 622 is longer than the length dimension $T_{PP}$ of the peripheral perforations 632 in order to at least partially address the mass flow velocity differences discussed above. It could also be said that the central region 620 has a thickness dimension that is different than a thickness of the peripheral region 630. It is acknowledged that the difference in lengths may in some embodiments have an opposite relationship. For example, to accommodate certain implementations of fuel and oxidant sources, combustion chambers, etc., the peripheral perforations 632 could have a greater length than the central perforations 622 while still having a larger lateral dimension $W_{PP}$. In the embodiment illustrated in FIG. 6C, the central perforations 622 all have a same length dimension $T_{PC}$ while all of the peripheral perforations 632 have a same length dimension $T_{PP}$. Embodiments that include more than two perforation lengths are discussed below.

According to an embodiment, in the case of a reticulated ceramic perforated reaction holder 102 (FIG. 15A and FIG. 15B), the central perforations 622 may have a first average length dimension $T_{PC}$ and the peripheral perforations 632 may have a second average length dimension $T_{PP}$. The first average length dimension $T_{PC}$ is larger than the second average length dimension $T_{PP}$.

Figure 6D:
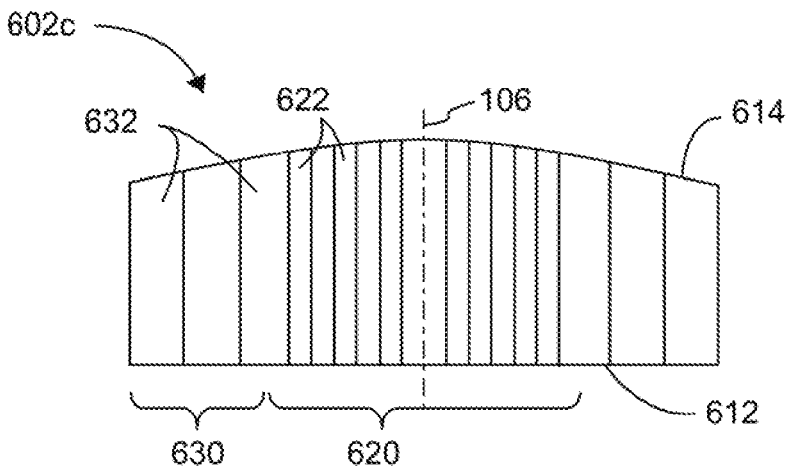
FIG. 6D is a side section view of a perforated reaction holder having perforations of various lengths and lateral dimensions, according to an embodiment.

FIG. 6D is a side section view of a perforated reaction holder 602*c* having a smoothly continuous output face 614 while retaining the different lateral dimensions of the central perforations 622 and the peripheral perforations 632 illustrated in FIGS. 6B-C. More specifically, as in FIGS. 6A-C, the central perforations 622 have a lateral dimension, $W_{PC}$, that is different from the lateral dimension $W_{PP}$ of the peripheral perforations 632. The central perforations 622 have an average length dimension between the input face 612 and output face 614 that is greater than an average length dimension of the peripheral perforations 632. However, rather than the stepped change in perforation length change shown in FIG. 6C, the thickness of the perforated reaction holder 602*c* and the lengths of the perforations change smoothly with distance from the central axis 106, e.g., with an arcuate cross-sectional profile. It is acknowledged that the differences in lengths between central perforations 622 and peripheral perforations 632 alternatively may be implemented via two or more discrete steps in perforation length (not illustrated).

Figure 7A:
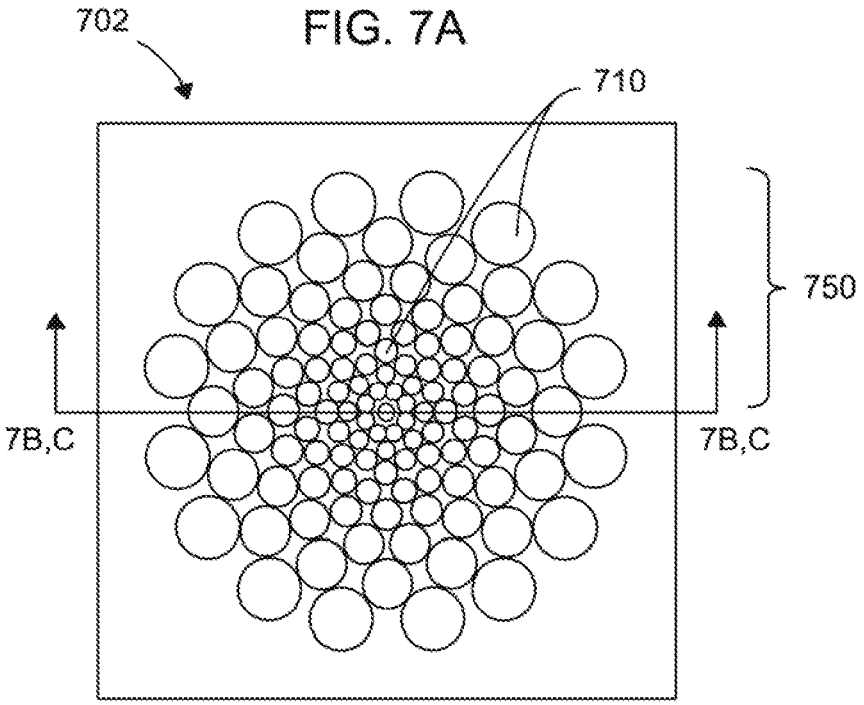
FIG. 7A is a top view of a perforated reaction holder having a variety of perforation sizes, according to an embodiment.

FIG. 7A is a top view of a perforated reaction holder 702 having perforations 710 with a variety of perforation sizes according to an embodiment. Lateral dimensions of perforations 710 may increase within a distance 750 from the central axis 106 of the perforated reaction holder 702 (the axis being shown in FIGS. 7B-C) to a peripheral extent of the perforations 710. In FIG. 7A, perforations 710 nearest the center of the perforated reaction holder 702 have a smallest lateral dimension 709 while perforations 710 farthest from the center of the perforated reaction holder 702 have a largest lateral dimension 711. The lateral dimensions of perforations 710 disposed respectively between the center (e.g. central axis 106) and a boundary of the perforated reaction holder 702 are respectively larger from the smallest lateral dimension 709 to the largest lateral dimension 711. It will be acknowledged that the cross-sectional shape of individual perforations 710 may differ from the round shape illustrated, and may include rectangular, hexagonal, oval, elliptical and/or other shapes. The perforations 710 may be laid out to attain a target aggregate perforation area and/or to accomplish manufacturing or combustion performance goals.

Figure 7B:
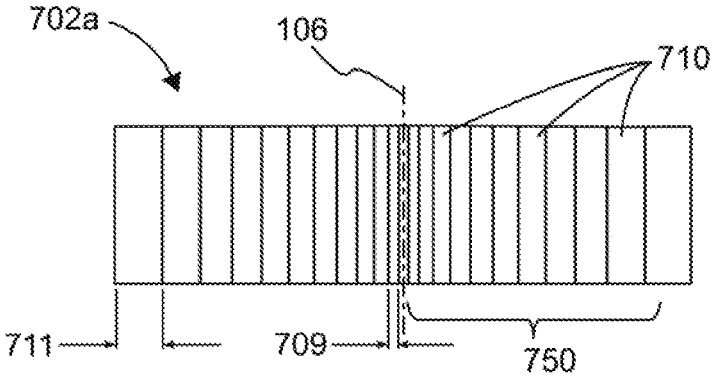
FIG. 7B is a side section view of the perforated reaction holder in FIG. 7A, according to an embodiment.

FIG. 7B is an idealized side section view of a perforated reaction holder 702*a* such as the perforated reaction holder 702 in FIG. 7A. The perforations 710 are shown as being immediately adjacent in this side section view, which departs somewhat from an actual cross-section of FIG. 7A. However, the reader will acknowledge that the lateral dimension of perforations 710 in FIG. 7B increase across the distance 750 from the central axis 106 of the perforated reaction holder 702*a*, just as they increase with the distance 750 from the center of the perforated reaction holder 702 in FIG. 7A. It will be acknowledged that a perforated reaction holder (not illustrated in top view) may be formed having a cross section that corresponds to FIG. 7B. The enlargement of the lateral dimension of the perforations 710 may be linear, logarithmic, or may increase in accord with a specific target mass flow velocity profile of a fuel and oxidant mixture 206 typical to a particular implementation.

Figure 7C:
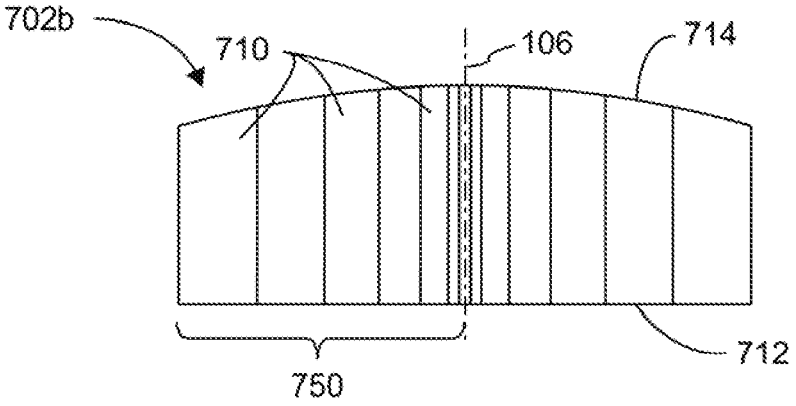
FIG. 7C is a side section view of the perforated reaction holder in FIG. 7A, according to another embodiment.

FIG. 7C is a side section view of a perforated reaction holder 702*b* having perforations 710 according to an embodiment. In addition to an increase in lateral dimension from the central axis 106, the respective perforations 710 may decrease in length with distance from the central axis 106. The combination of dimensional changes may be structured to compensate for a particular mass flow velocity in an implementation of the perforated reaction holder 702*b*. In FIG. 7C, the output face 714 may have a smooth, arcuate profile as illustrated, or may have a stepped or undulating profile (not shown).

Figure 8A:
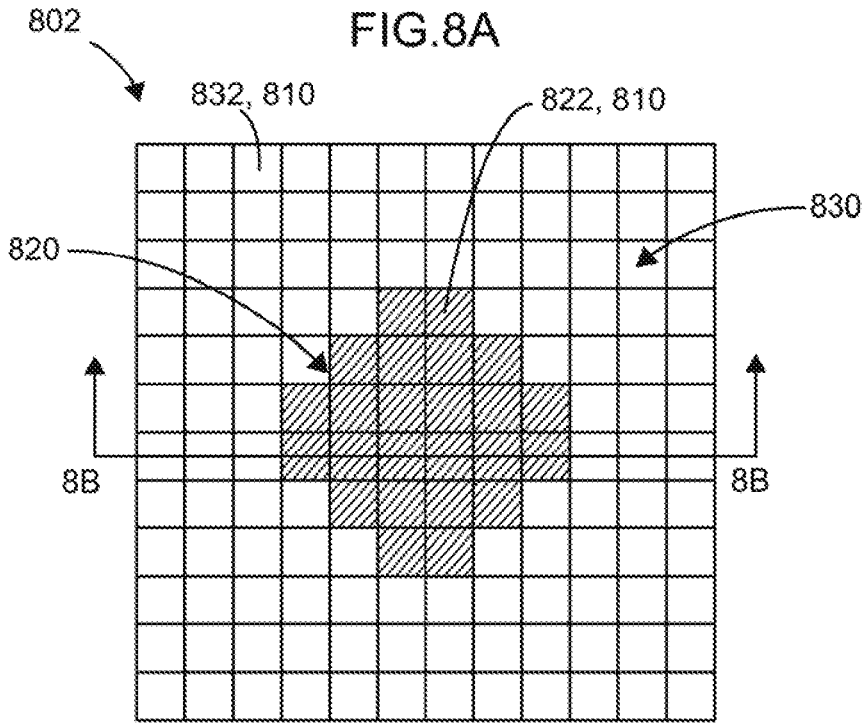
FIG. 8A is a top view of a perforated reaction holder having variety of perforation lengths, according to an embodiment.
Figure 8B:
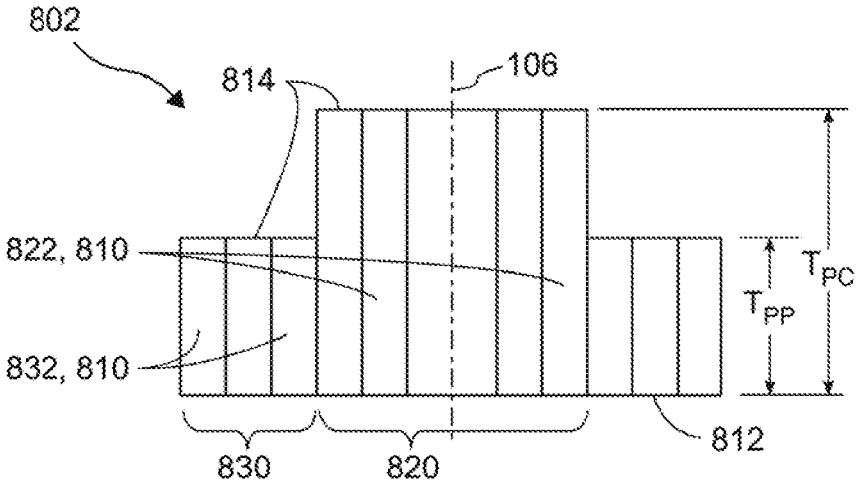
FIG. 8B is a side section view of the perforated reaction holder in FIG. 8A, according to an embodiment.

FIGS. 8A-B illustrate a perforated reaction holder 802 that compensates for cross-sectional fuel and oxidant mixture velocity profile by changing only the length of perforations 810 while a lateral dimension of the perforations 810 remains constant. FIG. 8A is a top view of a perforated reaction holder 802 having variety of perforation lengths. The perforated reaction holder 802 includes a central region 820 for alignment with a fuel and oxidant propagation axis, as shown in FIG. 8B. The central region 820 is typically, but not necessarily, disposed central to the perforated reaction holder 802. In FIG. 8A, the central region 820 is shaded only to help distinguish it from the peripheral region 830. The central region 820 includes central perforations 822 and the peripheral region 830 includes peripheral perforations 832. As shown in the side sectional view of FIG. 8B, the central perforations 822 may have a length dimension $T_{PC}$ that is greater than length dimension $T_{PP}$ of peripheral perforations 832. Similar to the perforated reaction holder 602*b* in FIG. 6C, the perforated reaction holder 802 may have a stepped output face 814.

Figure 9A:
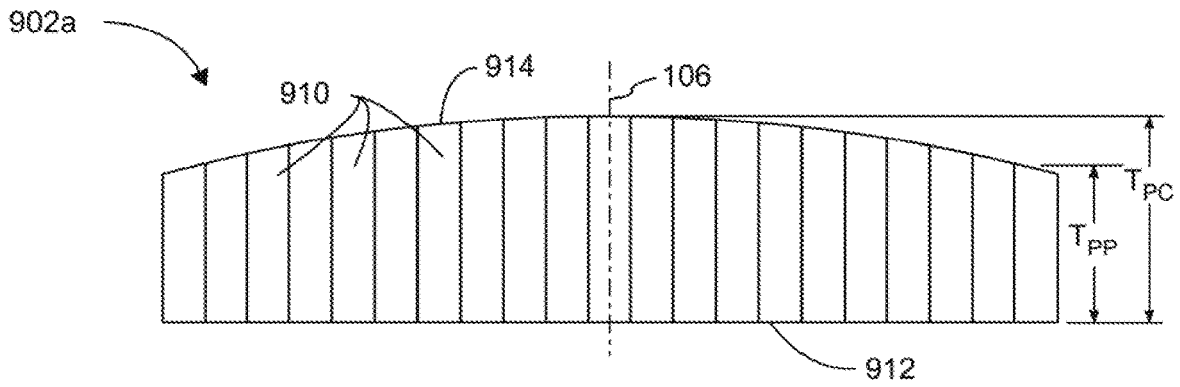
FIGS. 9A-B are side section views of alternative perforated reaction holders having a variety of perforation lengths with a continuous output face, according to an embodiment.
Figure 9B:
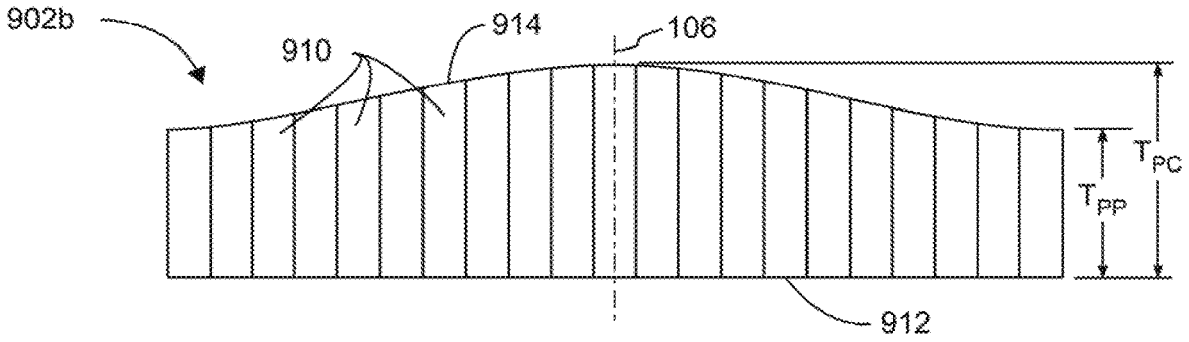

FIGS. 9A-B, in contrast to the stepped output face 814 of FIG. 8B, illustrate side section views of alternative perforated reaction holders 902*a*, 902*b* that implement a variety of perforation lengths between an input face 912 and output face 914 of the perforated reaction holder 902*a*, 902*b*. For example, output face 914 may have a smoothly arcuate profile (FIG. 9A) or a profile that curves according to a normal distribution (FIG. 9B). As suggested by the illustration, a lateral dimension of the perforations 910 may be constant. However, the inventors contemplate that the lateral dimensions may vary as in embodiments described elsewhere in this disclosure. The length dimensions of the perforations 910 decrease with distance from the central axis 106. Here, the length dimension $T_{PC}$ may represent a maximum perforation length at the central axis 106 and the length dimension $T_{PP}$ may represent a minimum perforation length at an edge of the perforated reaction holder 902*a*, 902*b*.

In all the embodiments disclosed herein the central axis 106 may correspond with the center of a single perforation (e.g., 210), or the central axis 106 may correspond to a non-perforation location of the perforated reaction holder(s) 902. For example, the central axis 106 may correspond to a perforation wall (e.g., 308) or with material otherwise disposed between perforations 910.

Figure 10:
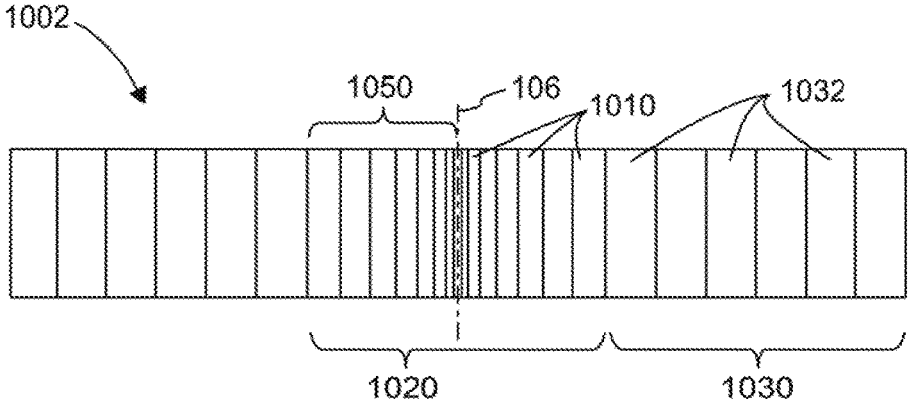
FIG. 10 is a side section view of a perforated reaction holder having perforations that increase in lateral dimension across a distance from the central axis to a lateral extent of the central region, whereas the perforations in a peripheral region may be uniformly sized, according to an embodiment.

The velocity compensation features described herein may be mixed and matched to address different fuel and/or oxidant features, velocities, chemical constitution or the like. For example, FIG. 10 shows a side section view of a perforated reaction holder 1002 having perforations 1010 that increase only across a distance 1050 from the central axis 106 to a lateral extent of the central region 1020, whereas peripheral perforations 1032 in a peripheral region 1030 may be uniformly sized. A perforated reaction holder (not shown) having the opposite constitution may be realized having, for example, uniformly sized perforations 1010 at the central region 1020 but a variety of perforation sizes in the peripheral region 1030.

Figure 11:
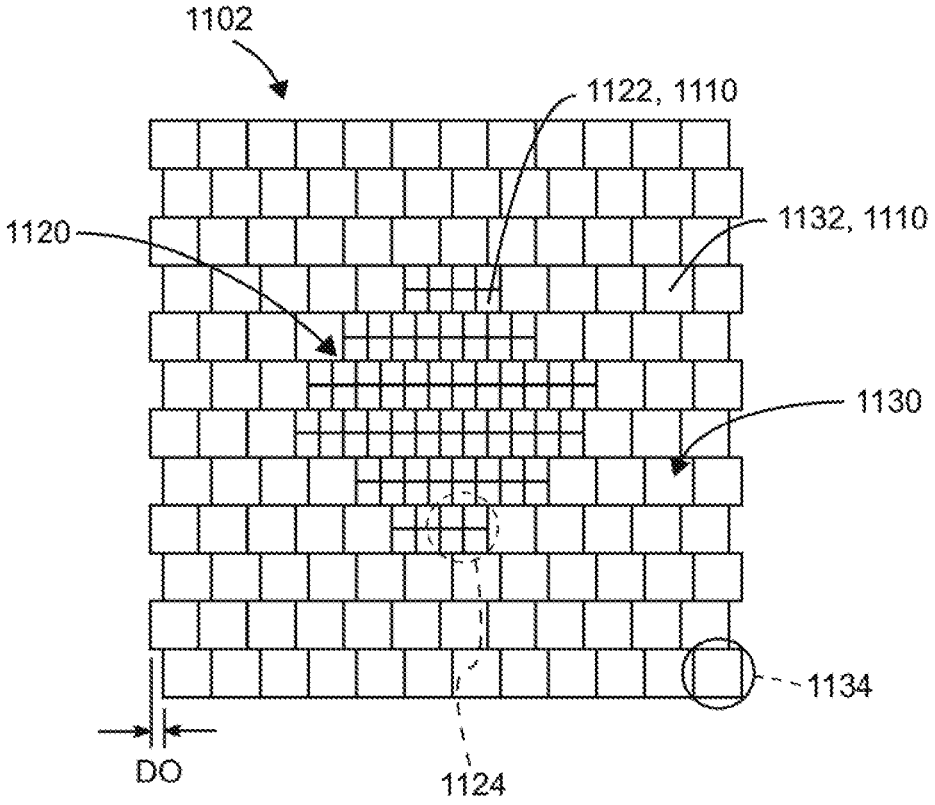
FIG. 11 is a top view of a tiled perforated reaction holder having a variety of perforation sizes, according to an embodiment.

FIG. 11 is a top view of a tiled perforated reaction holder 1102 having a variety of perforation sizes. Like the perforated reaction holder 602 in FIG. 6A, the tiled perforated reaction holder 1102 includes a central region 1120 and a peripheral region 1130. The central region 1120 is disposed axially about a central axis 106 (here considered to be orthogonal to the plane of the page) that is to be aligned about a fuel and oxidant propagation axis. The peripheral region 1130 is disposed axially about the central region 1120. Perforations 1110 may include central perforations 1122, disposed in the central region 1120 and having a first dimension; and peripheral perforations 1132, disposed in the peripheral region 1130 and having a second dimension. As with perforations 622 and 632 in FIGS. 6B-6D, the first and second dimensions may include, for example, a lateral dimension of the perforations 1122, 1132, a length dimension of the perforations 1122, 1132, and/or a ratio of the length dimension to the lateral dimension.

The perforated reaction holder 1102 may be formed from a plurality of adjacently disposed tiles 1124, 1134. In some instances, a cross-section of the perforated reaction holder 1102 may be very similar to the cross-sections shown in FIGS. 6B-6D in which instances tiles 1124 may include central perforations 1122 and are therefore disposed in a central region 1120 about the central axis 106. Tiles 1134 may include peripheral perforations 1132 and are disposed in the peripheral region 1130. Each tile 1124 in the central region 1120 may have a greater thickness dimension than tiles 1134 in the peripheral region 1130, and/or may include central perforations 1122 that have a smaller lateral dimension than peripheral perforations 1132 in the tiles 1134 of the peripheral region 1130. Tiles 1124, 1134 having a variety of lengths and/or perforation dimensions may be arranged such that an average tile length for tiles 1124 in the central region 1120 may be greater than an average tile length for tiles 1134 in the peripheral region 1130. This relationship of average lengths can result in some tiles 1134 in the peripheral region having a length that is greater than the length of some tiles 1124 in the central region 1120, while more tiles 1134 in the peripheral region 1130 have a shorter length dimension than that of most tiles 1124 in the central region 1120. Similarly, tiles 1124 in the central region 1120 may include central perforations 1122 having a lateral dimension that on average is smaller than an average lateral dimension for peripheral perforations 1132 of tiles 1134 in the peripheral region 1130.

In some embodiments, rows of tiles 1124, 1134 may be offset with respect to each other, e.g., by an offset distance DO as illustrated in FIG. 11. Such offset may improve structural integrity of the perforated reaction holder 1102 in some embodiments, for instance when the perforated reaction holder 1102 is disposed having its input face substantially vertical.

Figure 12A:
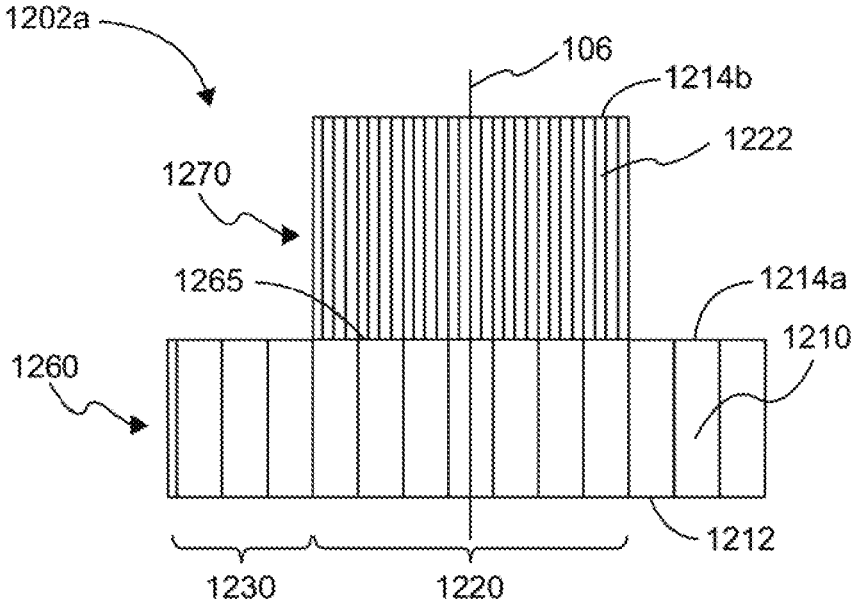
FIGS. 12A-12C are side section views of perforated reaction holders having a layered central region, according to an embodiment.
Figure 12B:
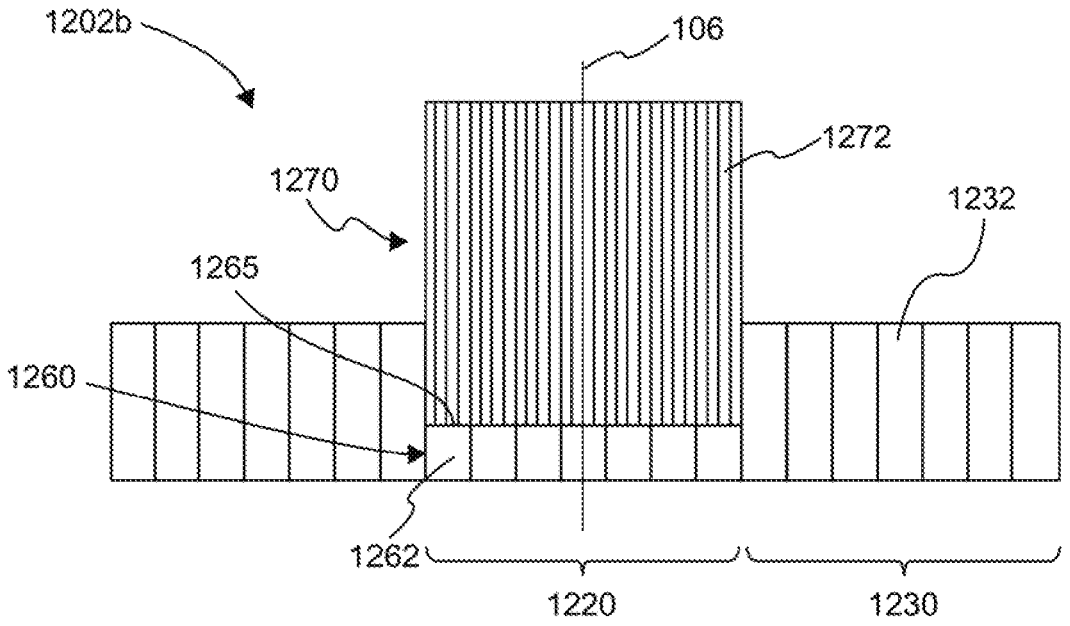
Figure 12C:
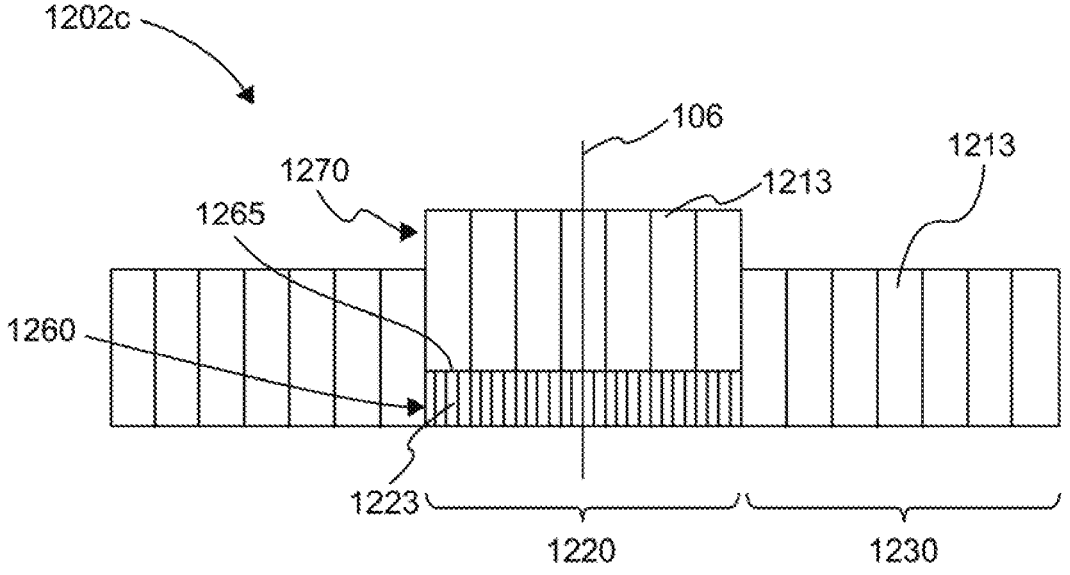

In yet other embodiments, tiles constituting the perforated reaction holder 1102 may form layers in a thickness direction of the perforated reaction holder 1102, e.g., as discussed with respect to FIGS. 12A-12C.

FIGS. 12A-12C are side section views of perforated reaction holders 1202(*a*-*c*) having a layered central region 1220 centered about a central axis 106 and surrounded by a peripheral region 1230. As in embodiments described above, the central and peripheral regions 1220, 1230 may have different dimensions, or different average dimensions, to compensate for non-uniform fuel and/or oxidant velocities seen across an input face of the perforated reaction holders 1202. In use, the central axis 106 may be aligned with a fuel and oxidant propagation axis of a combustion system as described above.

In FIG. 12A, a first layer 1260 constitutes both the peripheral region 1230 and a first layer of multiple layers of the central region 1220. That is, the first layer 1260 may be uniform in structure across the entire extent (e.g., width) of the perforated reaction holder 1202*a*. The first layer 1260 may have perforations 1210 distributed throughout, each having substantially similar dimensions. The first layer may include the entire input face 1212 and a peripheral portion of an output face 1214*a* of the perforated reaction holder 1202*a*. A second layer 1270 may be disposed opposite the input face 1212 in the central region 1220 and may extend the length of perforations 1210 in the central region 1220. At a layer junction 1265, the perforated reaction holder 1202*a* (and 1202*b,c* in FIGS. 12B, 12C) may include an attachment element to attach the first layer 1260 to the second layer 1270, such as high temperature mortar, metal clips or clamps, or the like (not shown). In some embodiments, the second layer 1270 may be sufficiently secure without dedicated securing means due to gravity and lack of sufficient external forces being sufficient to keep the second layer 1270 in place on the first layer 1260.

The central region 1220 may, according to an embodiment, be comprised of a continuous structure having two portions, in which each perforation 1210 in the first layer 1260 of the central region 1220 branches into one or more perforations 1222 without a break in the material forming the perforations 1210, 1222. In another embodiment, the first layer 1260 and the second layer 1270 may be distinct structures. Furthermore, each of the layers 1260, 1270 may be formed from pluralities of individual tiles similar, for one or more of the layers 1260, 1270, to what is described with respect to FIG. 11. It will also be acknowledged that more than two layers may be included and that a plurality of layers may together provide perforations 1210 in the central region 1220 or in the peripheral region 1230 having cross-sectional profiles of uniform dimensions (e.g., sub-perforations of each layer having a same lateral dimension), or may form perforations that vary in dimension from one layer to another (e.g., sub-perforation of each layer having a different lateral dimension). As shown in FIG. 12B-C, perforations 1223 of the first layer 1260 may have a different perforation length at the central region 1220 than at the peripheral region 1230.

Also as shown in FIG. 12C, sub-perforations 1213 of the second layer 1270 need not have a smaller lateral dimension than sub-perforations 1223 in the first layer 1260. In particular, sub-perforations 1223 in the first layer 1260 of the central region 1220 may each correspond to a fractional portion of a sub-perforation 1213 in the second layer 1270 of the central region 1220.

FIGS. 12B and 12C illustrate variations of the perforated reaction holder 1202 described for FIG. 12A. In FIG. 12B, the first layer 1260 of the central region 1220 includes sub-perforations 1262 having a length dimension that is shorter than the length dimension of sub-perforations 1272 in the second layer 1270 of the central region 1220, the sub-perforations 1262 and 1272 together forming one or more perforations that are longer than the peripheral perforations 1232.

According to an embodiment, the perforated reaction holder 1202*c* in FIG. 12C may be formed from 16 cells per square inch, 6 inch thick, 6 inch by 6 inch square cordierite tiles 1213. (It is acknowledged that the tiles 1213 in FIG. 12C have the same graphical presentation as perforations in other figures. In this instance each tile 1213, 1223 may be considered as including a plurality of perforations.) In some embodiments tiles 1213 may be stacked edgewise with high temperature mortar in between, for example a combustion system where fuel and oxidant are emitted horizontally toward a perforated reaction holder (see, e.g., the perforated reaction holder 102 in FIG. 5B). However, other means of securing the tiles 1213 together are contemplated, such as interlocking tiles, metal bands, etc., as discussed in detail in parent application PCT/US2015/039458, which, as noted above, is included in its entirety by reference herein. Higher density (or, alternatively, simply smaller lateral size), 2 inch thick tiles 1223 may be added endwise to the 6 inch thick tiles 1213 at and near the center axis 106 of the perforated reaction holder 1202*c* (which may correspond to the fuel and oxidant propagation axis). The additional sublayer 1260 of tiles 1223 may be 100 cells per square inch, two inch thick, 6 inch by 6 inch square cordierite reaction holder tiles 1223. The perforated reaction holder tiles 1213, 1223 can be square, cordierite reaction holder tiles. However, other tile shapes are contemplated, such as oval, elliptical, hexagonal, etc. Different densities and ratios of densities are considered. A larger perforation length and/or a smaller perforation cross-sectional area contribute to a higher L/D ratio for increased extent of reaction for combustion occurring within the perforated flame holder. Accordingly, different combinations of tiles for the perforated reaction holder 1202*c* may be implemented.

Figure 13A:
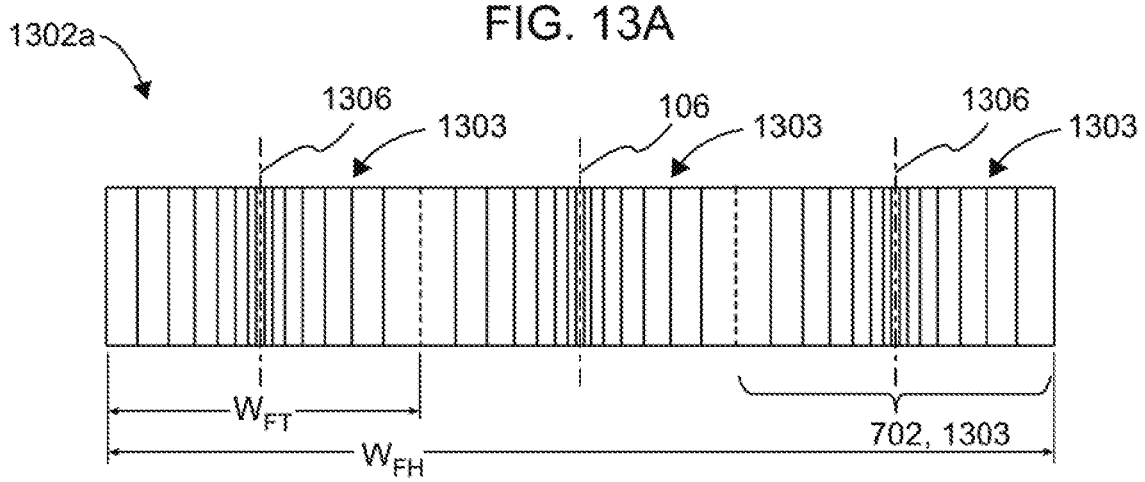
FIGS. 13A-13C are side section views of tiled perforated reaction holders, according to embodiments.
Figure 13B:
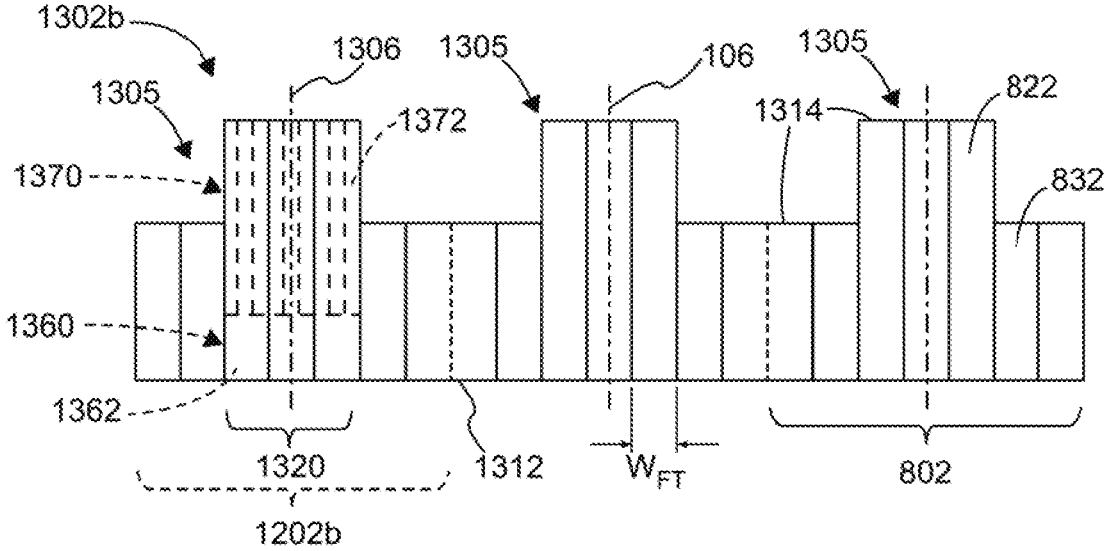
Figure 13C:
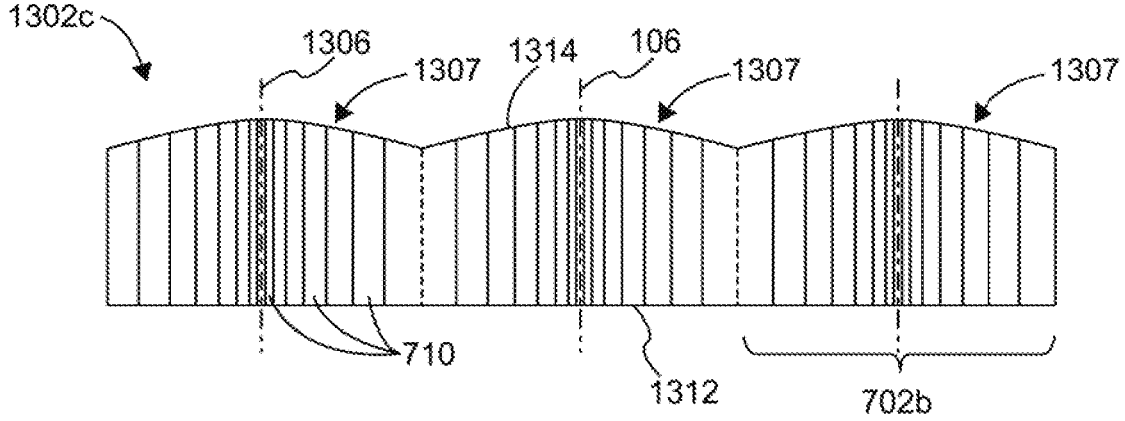

FIGS. 13A-13C illustrate side section views of tiled perforated reaction holders 1302*a*, 1302*b*, and 1302*c*. In combustion systems incorporating a plurality of fuel and/or oxidant sources (e.g., multiple fuel nozzles 218), each fuel and/or oxidant source may correspond to a respective fuel and oxidant propagation axis. FIG. 13A, for example, illustrates a perforated reaction holder 1302*a* that incorporates a plurality of modular perforated reaction holder tiles 1303. In some embodiments the modular perforated reaction holder tiles 1303 may correspond to the perforated reaction holder 702*a* described above with respect to FIG. 7B. Each modular perforated reaction holder tile 1303 may have its own central axis 106, 1306 for alignment with a respective fuel and oxidant propagation axis.

Each perforated reaction holder 1302(*a,b,c*) may be formed of tiles having a width dimension $W_{FT}$ less than the width dimension $W_{FH}$ of the perforated reaction holder 1302(*a,b,c*). For instance, the modular perforated reaction holder tiles 1303 in FIG. 13A may each incorporate perforations 710 having a variety of length and/or lateral dimensions as described for FIGS. 7A-B. Alternatively, a perforated reaction holder 1302 may include monolithic tiles each having its own uniform structure, similar to the tiles 1124, 1134 of the perforated reaction holder 1102 in FIG. 11. Such tiles may be arranged to form multiple central regions 1320 (e.g., like central region 1120 in FIG. 11) for alignment with respective fuel and oxidant propagation axes, and thus compensate for local fuel and oxidant velocity peaks.

FIGS. 13B, 13C illustrate tiled perforated reaction holders 1302*b*, 1302*c* that incorporate features of other embodiments, such as the structures of perforated reaction holders 802 and 702*b* described above. For example, perforated reaction tiles 1305 in FIG. 13B may include central perforations 822 having a greater perforation length (i.e., between the input and output faces 1312, 1314) than peripheral perforations 832 disposed peripheral to the central axes 106, 1306. Similar to FIG. 7C, each perforated reaction holder tile 1307 in FIG. 13C may include a smoothly arcuate output face 1314 and/or perforations 710 having respective lateral dimension that gradually increase with distance from the central axis 106, 1306 at least to a junction with an adjacent tile 1307.

It will be acknowledged that other perforated reaction holder structures described above may be incorporated in a tiled perforated reaction holder. For example, the left-hand tile 1305 of FIG. 13B illustrates an alternative structure (using dotted lines) corresponding to FIG. 12B having a central region 1320 that includes multiple layers, here including a first layer 1360 of the central region 1320 having central perforations 1362 of a first size followed by central perforations 1372 of a second size in a second layer 1370. Each perforation 1362 in the central region 1320 of the alternative left-hand tile 1305 may thus be considered to branch from a central perforation 1362 to plural perforations 1372.

In some embodiments, each tile (1303, 1305, 1307) may be uniform in design and size as illustrated in FIGS. 13A-13C. However, a tiled perforated reaction holder 1302 is not limited to uniformly structured tiles. For example, tiles may be selected to correspond with fuel and oxidant distribution patterns that vary according to position and/or orientation of the corresponding fuel and/or oxidant source.

According to an embodiment, perforated reaction holder tiles may be arranged for correspondence with fuel and oxidant propagation axes from fuel nozzles spatially clustered in a central location. A fuel and oxidant propagation axis corresponding to at least one of the fuel nozzles may be at a non-orthogonal angle with respect to the input face of such a tiled perforated reaction holder 1302. Accordingly, the tiled perforated reaction holder (not illustrated) may include tiles with perforations angled to accommodate the non-orthogonal fuel and oxidant propagation axis. Other tiles, closer to a central location directly opposite the fuel nozzles, may have perforations that are comparatively orthogonal to the input face of the perforated reaction holder 1302.

According to another embodiment, a perforated reaction holder (not shown) can define a central aperture, about which a first set of apertures or perforations may be arranged in a concentric arrangement relative to the central aperture and having a selected spacing and size. A second set of apertures or perforations may be arranged in concentric arrangement relative to the central aperture and having a different selected spacing and size. The perforated reaction holder can be configured to hold the fuel combustion reaction 302 between an input surface and an output surface of the perforated reaction holder.

Figure 14:
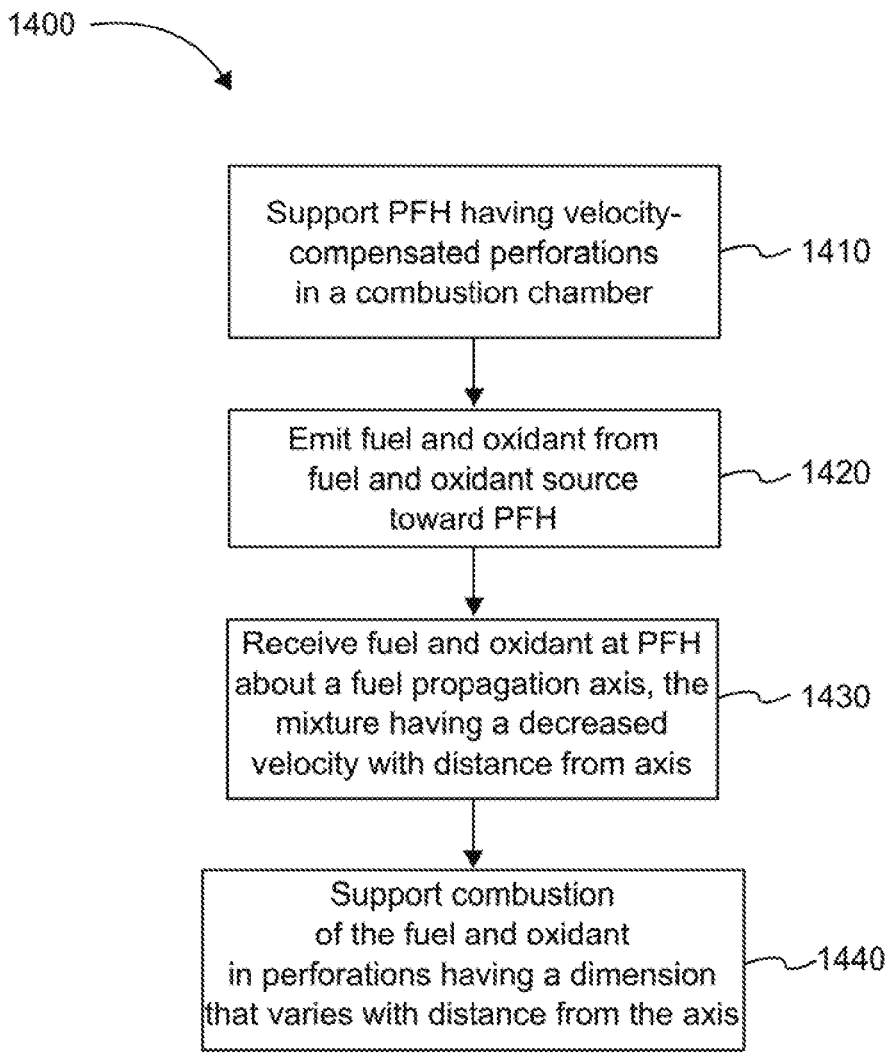
FIG. 14 is a flow chart showing a method for operating a burner system including the perforated reaction holder of disclosed perforated reaction holders, according to an embodiment.

FIG. 14 is a flow chart showing a method 1400 for operating a burner system including the perforated reaction holder of disclosed perforated reaction holders according to an embodiment. In operation 1410, a perforated flame holder ("PFH," also referred to as a "perforated reaction holder") having velocity-compensated perforations is supported in a combustion chamber. The embodiments of perforated reaction holders as described above, and obvious variations thereof, can be implemented in this operation. In operation 1420, a fuel and oxidant source emits fuel and oxidant toward the PFH. In operation 1430, the fuel and oxidant is received by the PFH about a fuel and oxidant propagation axis which, as described above, is an axis of highest average fuel and oxidant propagation, and fuel and oxidant velocity at the input face of the PFH decreases with distance from the fuel and oxidant propagation axis. In operation 1440, the PFH supports combustion of the fuel and oxidant in perforations that differ in dimension depending on their disposition with respect to the fuel and oxidant propagation axis.

Supporting the combustion reaction within the central perforations may include supporting transit of the fuel and oxidant along a greater length distance within the central perforations than within the peripheral perforations. Additionally, or alternatively, supporting the combustion reaction within the central perforations may include supporting the transit of fuel and oxidant through a smaller lateral dimension within the central perforations than within the peripheral perforations.

The first dimension and the second dimension may be average lengths respectively of the central perforations and the peripheral perforations through a thickness of the perforated reaction holder (i.e., between an input face and an output face). The lengths of respective perforations of the plurality of perforations may decrease continuously with distance from a central axis of the PFH.

The first dimension and the second dimension may be average lateral dimensions respectively of the central perforations and the peripheral perforations, and are transverse to the thickness (between the input and output faces) of the perforated reaction holder. The lateral dimension of respective perforations of the plurality of perforations may be successively larger with distance from the central axis. The average lateral dimension of the central perforations may be smaller than the average lateral dimension of the peripheral perforations, and the lateral dimensions of the central perforations support the combustion reaction within the central perforations via transit of fuel and oxidant through smaller lateral dimensions than within the peripheral perforations.

Figure 15A:
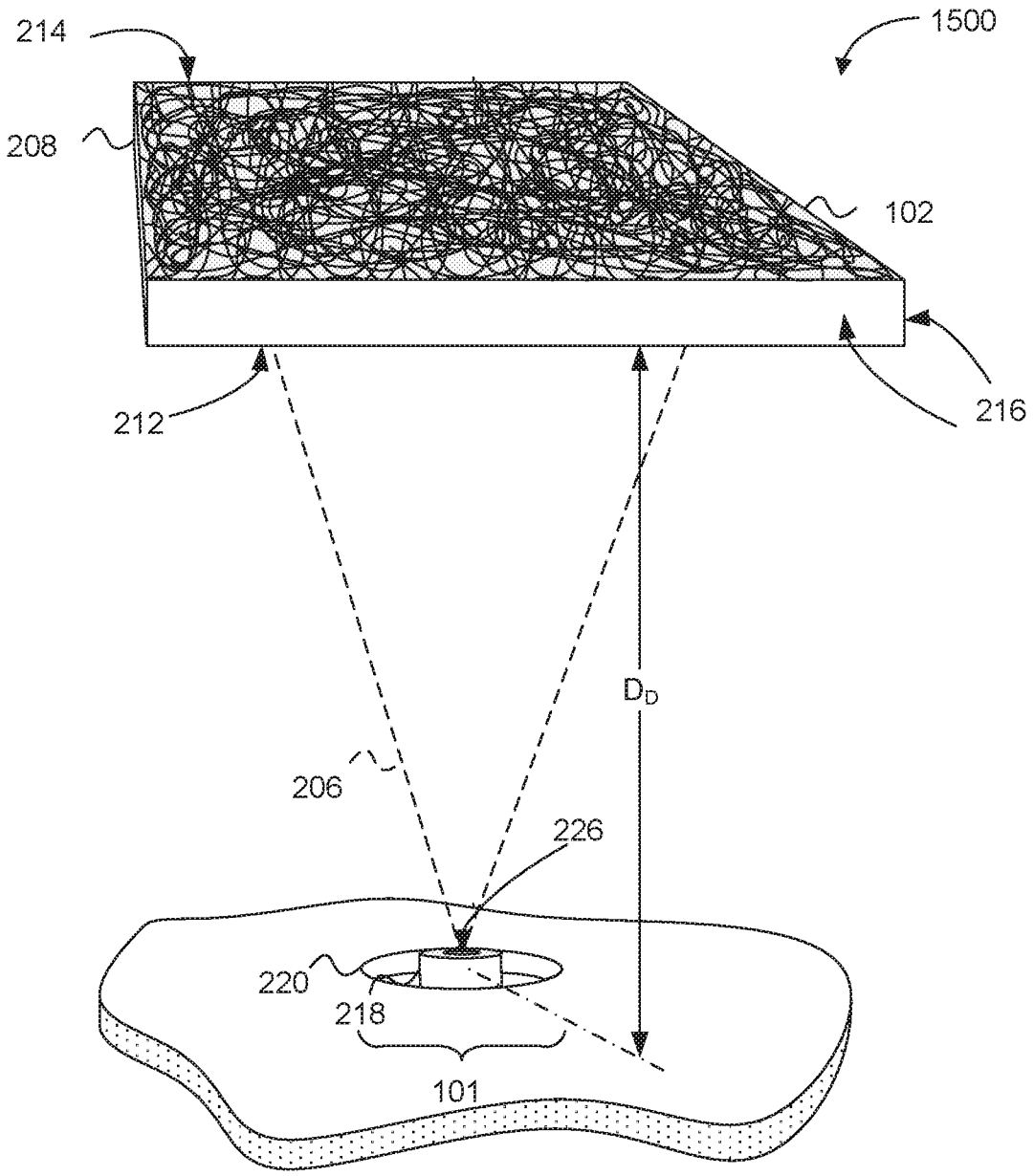
FIG. 15A is a simplified perspective view of a combustion system including a reticulated ceramic perforated reaction holder, according to an embodiment.
Figure 15B:
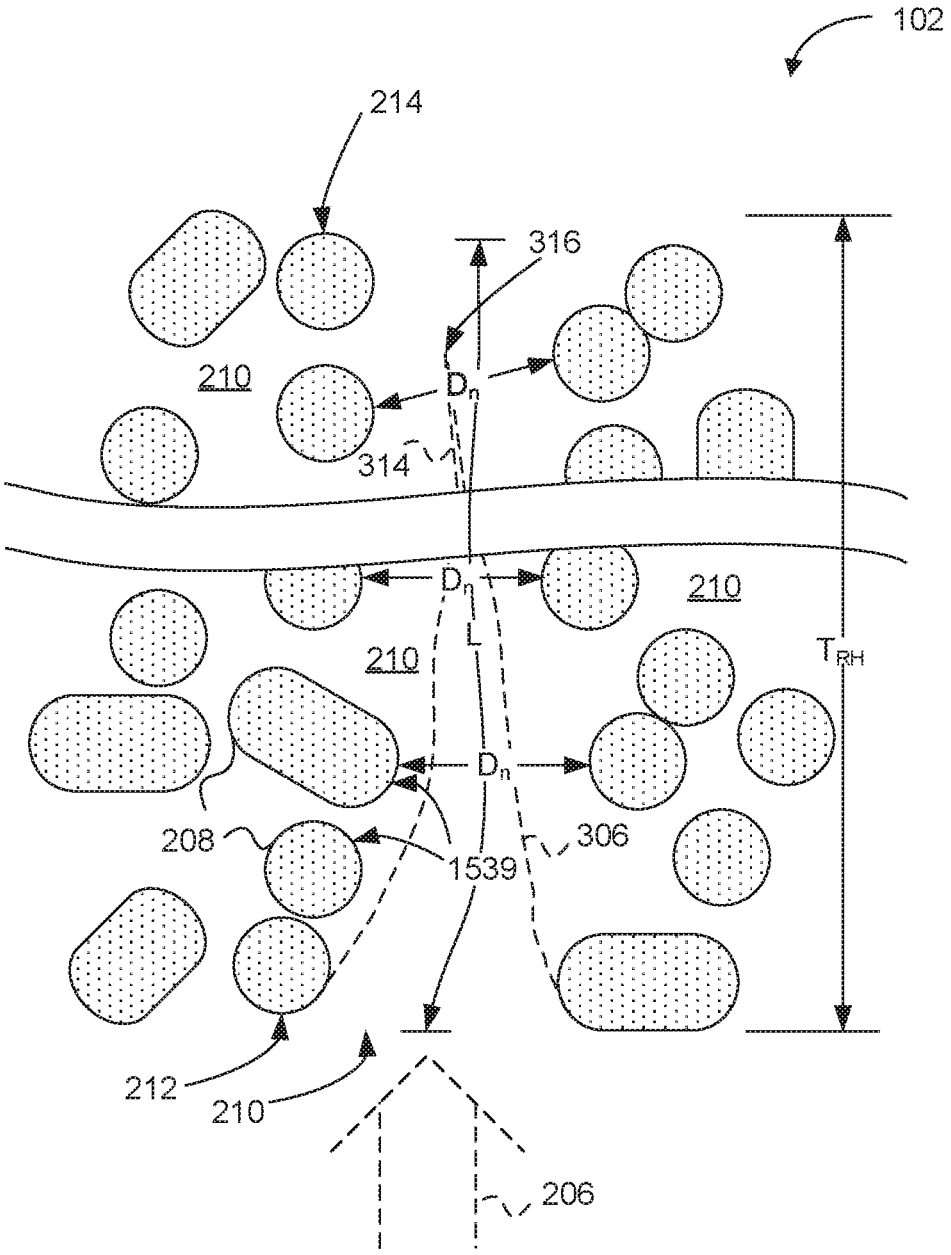
FIG. 15B is a simplified side sectional diagram of a portion of the reticulated ceramic perforated reaction holder of FIG. 15A, according to an embodiment.

FIG. 15A is a simplified perspective view of a combustion system 1500, including another alternative perforated reaction holder 102, according to an embodiment. The perforated reaction holder 102 is a reticulated ceramic perforated reaction holder, according to an embodiment. FIG. 15B is a simplified side sectional diagram of a portion of the reticulated ceramic perforated reaction holder 102 of FIG. 15A, according to an embodiment. The perforated reaction holder 102 of FIGS. 15A, 15B can be implemented in the various combustion systems described herein, according to an embodiment. The perforated reaction holder 102 is configured to support a combustion reaction of the fuel and oxidant 206 at least partially within the perforated reaction holder 102.

According to an embodiment, the perforated reaction holder body 208 can include reticulated fibers 1539. The reticulated fibers 1539 can define branching perforations 210 that weave around and through the reticulated fibers 1539. According to an embodiment, the perforations 210 are formed as passages through the reticulated ceramic fibers 1539.

According to an embodiment, the reticulated fibers 1539 can include alumina silicate. According to an embodiment, the reticulated fibers 1539 can be formed from extruded mullite or cordierite. According to an embodiment, the reticulated fibers 1539 can include Zirconia. According to an embodiment, the reticulated fibers 1539 can include silicon carbide.

The term "reticulated fibers" refers to a netlike structure. According to an embodiment, the reticulated fibers 1539 are formed from an extruded ceramic material. In reticulated fiber embodiments, the interaction between the fuel and oxidant 206, the combustion reaction, and heat transfer to and from the perforated reaction holder body 208 can function similarly to the embodiment shown and described above with respect to FIGS. 2-4. One difference in activity is a mixing between perforations 210, because the reticulated fibers 1539 form a discontinuous perforated reaction holder body 208 that allows flow back and forth between neighboring perforations 210.

According to an embodiment, the reticulated fiber network is sufficiently open for downstream reticulated fibers 1539 to emit radiation for receipt by upstream reticulated fibers 1539 for the purpose of heating the upstream reticulated fibers 1539 sufficiently to maintain combustion of a fuel and oxidant 206. Compared to a continuous perforated reaction holder body 208, heat conduction paths 312 between fibers 1539 are reduced due to separation of the fibers 1539. This may cause relatively more heat to be transferred from the heat-receiving region 306 (heat receiving area) to the heat-output region 310 (heat output area) of the reticulated fibers 1539 via thermal radiation.

According to an embodiment, individual perforations 210 may extend from an input face 212 to an output face 214 of the perforated reaction holder 102. Perforations 210 may have varying lengths L. According to an embodiment, because the perforations 210 branch into and out of each other, individual perforations 210 are not clearly defined by a length L.

According to an embodiment, the perforated reaction holder 102 is configured to support or hold a combustion reaction or a flame at least partially between the input face 212 and the output face 214. According to an embodiment, the input face 212 corresponds to a surface of the perforated reaction holder 102 proximal to the fuel nozzle 218 or to a surface that first receives fuel. According to an embodiment, the input face 212 corresponds to an extent of the reticulated fibers 1539 proximal to the fuel nozzle 218. According to an embodiment, the output face 214 corresponds to a surface distal to the fuel nozzle 218 or opposite the input face 212. According to an embodiment, the input face 212 corresponds to an extent of the reticulated fibers 1539 distal to the fuel nozzle 218 or opposite to the input face 212.

According to an embodiment, the formation of boundary layers 314, transfer of heat between the perforated reaction holder body 208 and the gases flowing through the perforations 210, a characteristic perforation width dimension D, and the length L can be regarded as related to an average or overall path through the perforated reaction holder 102. In other words, the dimension D can be determined as a root-mean-square of individual Dn values determined at each point along a flow path. Similarly, the length L can be a length that includes length contributed by tortuosity of the flow path, which may be somewhat longer than a straight line distance $T_{RH}$ from the input face 212 to the output face 214 through the perforated reaction holder 102. According to an embodiment, the void fraction (expressed as total perforated reaction holder 102 volume−fiber 1539 volume)/total volume)) can vary at different regions of the perforated reaction holder 102. An individual reticulated ceramic perforated flame holder 102 can include a central region with different characteristics than a peripheral region, such that average dimensions of the central perforations in the central region are different than average dimensions of the central perforations in the peripheral region.

According to an embodiment, the reticulated ceramic perforated reaction holder 102 can include shapes and dimensions other than those described herein. For example, the perforated reaction holder 102 can include reticulated ceramic tiles that are larger or smaller than the dimensions set forth above. Additionally, the reticulated ceramic perforated reaction holder 102 can include shapes other than generally cuboid shapes.

According to an embodiment, the reticulated ceramic perforated reaction holder 102 can include multiple reticulated ceramic tiles. The multiple reticulated ceramic tiles can be joined together such that each ceramic tile is in direct contact with one or more adjacent reticulated ceramic tiles. The multiple reticulated ceramic tiles can collectively form a single perforated reaction holder 102. The multiple reticulated ceramic tiles can have perforations 210 characterized by differing average dimensions, can have differing void fractions, differing densities of reticulated fibers 1539, differing numbers of pores per square inch of surface area of the input and output faces 212 and 214, differing thicknesses, differing average distances between adjacent reticulated fibers 1539, or other average dimensions.

According to an embodiment, a perforated flame holder 102 may include one or more central reticulated ceramic tiles corresponding to a central region and one or more peripheral reticulated ceramic tiles corresponding to a peripheral region. The central reticulated ceramic tiles may have differing dimensions and characteristics than the peripheral reticulated ceramic tiles. The central region may include a stack of two or more reticulated ceramic tiles.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A combustion system, comprising:

a combustion chamber;

a fuel and oxidant source oriented to emit fuel and oxidant into the combustion chamber; and a perforated reaction holder disposed in the combustion chamber and oriented to receive the fuel and the oxidant at an input face, the perforated reaction holder defining a plurality of perforations of different sizes, the perforations arranged by size to accommodate a combustion reaction substantially within each perforation when the fuel and the oxidant are received at different velocities across the input face of the perforated reaction holder.

2. The combustion system of claim 1, wherein the fuel and oxidant source is oriented to emit the fuel and the oxidant toward the input face of the perforated reaction holder about a fuel and oxidant propagation axis, an average velocity of the fuel and the oxidant at the fuel and oxidant propagation axis being higher than at locations peripheral to the fuel and oxidant propagation axis.

3. The combustion system of claim 2, wherein:

the perforated reaction holder defines the plurality of perforations;

the plurality of perforations include central perforations and peripheral perforations that extend between the input face and an output face of the perforated reaction holder, the central perforations disposed in a central region of the perforated reaction holder have a central axis that is aligned substantially coaxial to the fuel and oxidant propagation axis, and the peripheral perforations disposed in a peripheral region peripheral to the central region; and the central perforations have a first dimension and the peripheral perforations have a second dimension different from the first dimension.

4. The combustion system of claim 3, wherein the first dimension is an average ratio of length to cross-sectional area for the central perforations and the second dimension is an average ratio of length to cross-sectional area for the peripheral perforations, a respective length of each perforation of the plurality of perforations being a distance between the input face and the output face of the perforated reaction holder at each respective perforation, and the cross-sectional area being transverse to the thickness; and wherein the average ratio for the central perforations is larger than the average ratio for the peripheral perforations.

5. The combustion system of claim 4, wherein the ratio of length to cross-sectional area for successive perforations decreases with distance from the fuel and oxidant propagation axis for perforations in at least one of the central region and the peripheral region.

6. The combustion system of claim 4, wherein the ratio of length to cross-sectional area is decreased step-wise in at least one step with distance from the fuel and oxidant propagation axis for at least one of the central perforations and the peripheral perforations.

7. The combustion system of claim 3, wherein the first dimension is an average length of the central perforations between the input face and the output face of the perforated reaction holder and the second dimension is an average length of the peripheral perforations between the input face and the output face of the perforated reaction holder.

8. The combustion system of claim 7, wherein the central region of the perforated reaction holder includes a plurality of layers not all of which are also in the peripheral region, each layer having layer perforations, consecutive layer perforations of the plurality of layers together constituting the central perforations.

9. The combustion system of claim 8, wherein a lateral dimension of the layer perforations for a first layer of the plurality of layers is different from a lateral dimension of layer perforations for a second layer of the plurality of layers.

10. The combustion system of claim 3, wherein the first dimension and the second dimension are average lateral dimensions respectively of the central perforations and of the peripheral perforations transverse to a thickness of the perforated reaction holder, and wherein the lateral dimensions of the central perforations are, on average, smaller than the lateral dimensions of the peripheral perforations, the lateral dimensions of the central perforations and the peripheral perforations respectively selected to compensate for the difference in the average velocity of the fuel and the oxidant received across the input face at the central perforations and the peripheral perforations for said support of the combustion reaction within the central perforations and the peripheral perforations.

11. The combustion system of claim 10, wherein the lateral dimensions of the central perforations and the lateral dimensions of the peripheral perforations are respectively cross-sectional areas of the central perforations and peripheral perforations.

12. The combustion system of claim 3, wherein the first dimension and the second dimension are respective average lengths of the central perforations and the peripheral perforations through the thickness of the perforated reaction holder, and the lengths of individual perforations of at least one of the central perforations and the peripheral perforations are successively shorter with distance from the fuel and oxidant propagation axis along the input face of the perforated reaction holder.

13. The combustion system of claim 12, wherein the average length of the central perforations is greater than the average length of the peripheral perforations, the lengths of the plurality of perforations being selected to compensate for the difference in the average velocity of the fuel and the oxidant received across the input side at the central perforations and the peripheral perforations for said support of the combustion reaction within the central perforations and the peripheral perforations.

14. The combustion system of claim 3, wherein the first dimension and the second dimension are average lateral dimensions respectively of the central perforations and the peripheral perforations transverse to a thickness of the perforated reaction holder, and the lateral dimensions of respective perforations of at least one of the central perforations and the peripheral perforations are successively wider with distance from the fuel and oxidant propagation axis.

15. The combustion system of claim 14, wherein the average lateral dimension of the central perforations is smaller than the average lateral dimension of the peripheral perforations, the lateral dimensions of the plurality of perforations being selected to compensate for the difference in the average velocity of the fuel and the oxidant for said support of the combustion reaction within the central perforations and the peripheral perforations.

16. The combustion system of claim 3, further comprising additional fuel and oxidant sources each having a respective fuel and oxidant propagation axis, wherein the perforated reaction holder includes a plurality of the central regions each aligned substantially coaxial respectively to at least one of the respective fuel and oxidant propagation axes.

17. The combustion system of claim 3, wherein the perforated reaction holder is a reticulated ceramic perforated reaction holder.

18. The combustion system of claim 17, wherein the perforated reaction holder includes a plurality of reticulated fibers and wherein the perforations are branching perforations.

19. The combustion system of claim 18, wherein the perforated reaction holder is configured to support at least a portion of the combustion reaction within the perforated reaction holder between the input face and the output face.

20. The combustion system of claim 18, wherein the central perforations are on average narrower than the peripheral perforations.

21. The combustion system of claim 18, wherein the central perforations are on average longer than the peripheral perforations.

22. The combustion system of claim 18, wherein the input surface includes more pores per unit surface area at the central region than does the peripheral region.

23. The combustion system of claim 18, wherein the central region is thicker than the peripheral region in a dimension corresponding to the fuel and propagation axis, and wherein the central region includes multiple stacked reticulated ceramic tiles.

24. The combustion system of claim 18, wherein an average ratio of length to cross-sectional area for the central perforations is larger than an average ratio of length to cross-sectional area for the peripheral perforations.

25. The combustion system of claim 24, wherein the ratio of length to cross-sectional area for successive perforations decreases with distance from the fuel and oxidant propagation axis for the perforations in at least one of the central region and the peripheral region.

26. The combustion system of claim 24, wherein the ratio of length to cross-sectional area is decreased step-wise in at least one step with distance from the fuel and oxidant propagation axis for at least one of the central perforations and the peripheral perforations.

* * * * *